US009559428B1

(12) United States Patent
Jensen et al.

(10) Patent No.: US 9,559,428 B1
(45) Date of Patent: Jan. 31, 2017

(54) COMPACT WAVEGUIDE POWER COMBINER/DIVIDER FOR DUAL-POLARIZED ANTENNA ELEMENTS

(71) Applicant: ViaSat, Inc., Carlsbad, CA (US)

(72) Inventors: Anders Jensen, Johns Creek, GA (US); Dominic Q. Nguyen, Irvine, CA (US); Donald L. Runyon, Peachtree Corners, GA (US)

(73) Assignee: ViaSat, Inc., Carlsbad, CA (US)

( * ) Notice: Subject to any disclaimer, the term of this patent is extended or adjusted under 35 U.S.C. 154(b) by 20 days.

(21) Appl. No.: 14/835,252

(22) Filed: Aug. 25, 2015

(51) Int. Cl.
*H01Q 19/10* (2006.01)
*H01Q 15/24* (2006.01)
*H01Q 21/00* (2006.01)

(52) U.S. Cl.
CPC ..... *H01Q 15/242* (2013.01); *H01Q 21/0037* (2013.01)

(58) Field of Classification Search
None
See application file for complete search history.

(56) References Cited

U.S. PATENT DOCUMENTS

2013/0120206 A1* 5/2013 Biancotto ..... H01Q 21/005 343/776
2014/0145893 A1* 5/2014 Park ..... H01Q 13/02 343/756
2015/0162668 A1 6/2015 Oppenlaender et al.
2015/0188236 A1 7/2015 Oppenlaender et al.
2015/0188238 A1 7/2015 Oppenlaender et al.
2016/0020519 A1 1/2016 Park et al.

* cited by examiner

*Primary Examiner* — Trinh Dinh
(74) *Attorney, Agent, or Firm* — Holland & Hart LLP

(57) ABSTRACT

A waveguide architecture for a dual-polarized antenna including multiple antenna elements. Aspects are directed to dual-polarized antenna architectures where each antenna element includes a polarizer having an individual waveguide with dual-polarization signal propagation and divided waveguides associated with each basis polarization. The waveguide architecture may include unit cells having corporate waveguide networks associated with each basis polarization connecting each divided waveguide of the polarizers of each antenna element in the unit cell with a respective common waveguide. The waveguide networks may have waveguide elements located within the unit-cell boundary with a small or minimized inter-element distance. Thus, unit cells may be positioned adjacent to each other in a waveguide device assembly for a dual-polarized antenna array without increased inter-element distance between antenna elements of adjacent unit cells. Antenna waveguide ports may be connected to unit cell common waveguides using elevation and azimuth waveguide networks of the corporate type.

16 Claims, 17 Drawing Sheets

COMPACT WAVEGUIDE POWER COMBINER/DIVIDER FOR DUAL-POLARIZED ANTENNA ELEMENTS

BACKGROUND

Antenna arrays including waveguide antenna elements can provide desirable performance for communication over long distances. Passive antenna arrays with waveguide feed networks are one of the most suited technologies for antenna arrays because of the low level of losses they exhibit. As the number of antenna elements increases, the waveguide feed networks become increasingly complex and space consuming. This can be problematic in many environments (e.g., avionics) where space and/or weight are at a premium. In some cases, inter-element distance between the antenna elements may be constrained by the feed network size, which may degrade antenna performance.

A common problem with this type of architecture is grating lobes in the radiation pattern of the array, which happens if the inter-element distance is too large. Indeed, the fact that waveguides occupy more lateral space than other types of transmission medium (e.g., microstrip, etc.) can make it difficult to reduce the inter-element distance sufficiently to avoid grating lobes. This limitation can be even more severe with dual-polarized arrays, where the feed network system handles two channels, for the two orthogonal basis polarizations. Current architectures of dual-polarized antenna arrays using waveguide antenna elements use a larger than desired inter-element distance or sharing of a common excitation port among multiple antenna elements. These solutions can have drawbacks including increased grating lobes or reduced antenna efficiency.

SUMMARY

A waveguide architecture for a dual-polarized antenna including multiple antenna elements. Aspects are directed to architectures where each antenna element includes a polarizer having an individual waveguide with dual-polarization signal propagation and divided waveguides associated with each basis polarization. In some aspects, the waveguide architecture includes unit cells having corporate waveguide networks associated with each basis polarization connecting each divided waveguide of the polarizers of each antenna element in the unit cell with a respective common waveguide. The inter-element distance for antenna elements within each unit cell may be small relative to the desired operational frequency range (e.g., to provide grating lobe free operation at the highest operating frequency, etc.) and unit cells may be positioned adjacent to each other in a waveguide device assembly for a dual-polarized antenna array without increased inter-element distance between antenna elements of adjacent unit cells. Antenna waveguide ports may be connected to unit cell common waveguides using elevation and azimuth waveguide networks of the corporate type.

A dual-polarized antenna is described. The dual-polarized antenna may include multiple unit cells, where each unit cell includes a first common waveguide associated with a first polarization, a second common waveguide associated with a second polarization, a two-by-two array of antenna elements, each antenna element including a polarizer coupled between an individual waveguide and first and second divided waveguides associated with the first and second polarizations, respectively, and where a cross-section of the individual waveguides of the two-by-two array defines a unit cell boundary for each unit cell, a first waveguide network comprising at least one waveguide combiner/divider and connecting each of the first divided waveguides of the plurality of antenna elements with the first common waveguide via a continuous waveguide signal path, and a second waveguide network including at least one waveguide combiner/divider and connecting each of the second divided waveguides of the plurality of antenna elements with the second common waveguide via a continuous waveguide signal path. The first waveguide network and the second waveguide network may each be entirely within a projection of the unit cell boundary along a direction that is normal to the cross-section that defines unit cell boundary.

Further scope of the applicability of the described methods and apparatuses will become apparent from the following detailed description, claims, and drawings. The detailed description and specific examples are given by way of illustration only, since various changes and modifications within the scope of the description will become apparent to those skilled in the art.

BRIEF DESCRIPTION OF THE DRAWINGS

A further understanding of the nature and advantages of embodiments of the present disclosure may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The described features generally relate to a dual polarized antenna (referred to herein as an "antenna array" or simply an "antenna"). The described features include a scalable waveguide architecture for a dual-polarized antenna using unit cells having multiple antenna elements, where each antenna element includes a polarizer (e.g., septum polarizer) having divided waveguide ports associated with each basis polarization. The unit cells may have corporate waveguide networks associated with each basis polarization connecting the divided waveguides of each antenna element to common waveguides of the unit cell associated with each basis polarization. The waveguide networks may include ridged waveguide components and/or non-ridged waveguide components. The inter-element distance between antenna elements within each unit cell may be selected to provide grating lobe free operation at the highest operating frequency and unit cells may be positioned adjacent to each other without increasing inter-element distance between antenna elements of adjacent unit cells. Thus, the inter-element distance may be small relative to the operating frequency range and consistent across a waveguide assembly of unit cells, minimizing grating lobes for the dual-polarized antenna.

This description provides examples, and is not intended to limit the scope, applicability or configuration of embodiments of the principles described herein. Rather, the ensuing description will provide those skilled in the art with an enabling description for implementing embodiments of the principles described herein. Various changes may be made in the function and arrangement of elements.

Thus, various embodiments may omit, substitute, or add various procedures or components as appropriate. For instance, it should be appreciated that the methods may be performed in an order different than that described, and that various steps may be added, omitted or combined. Also, aspects and elements described with respect to certain embodiments may be combined in various other embodiments. It should also be appreciated that the following systems, methods, devices, and software may individually or collectively be components of a larger system, wherein other procedures may take precedence over or otherwise modify their application.

Figure 1:
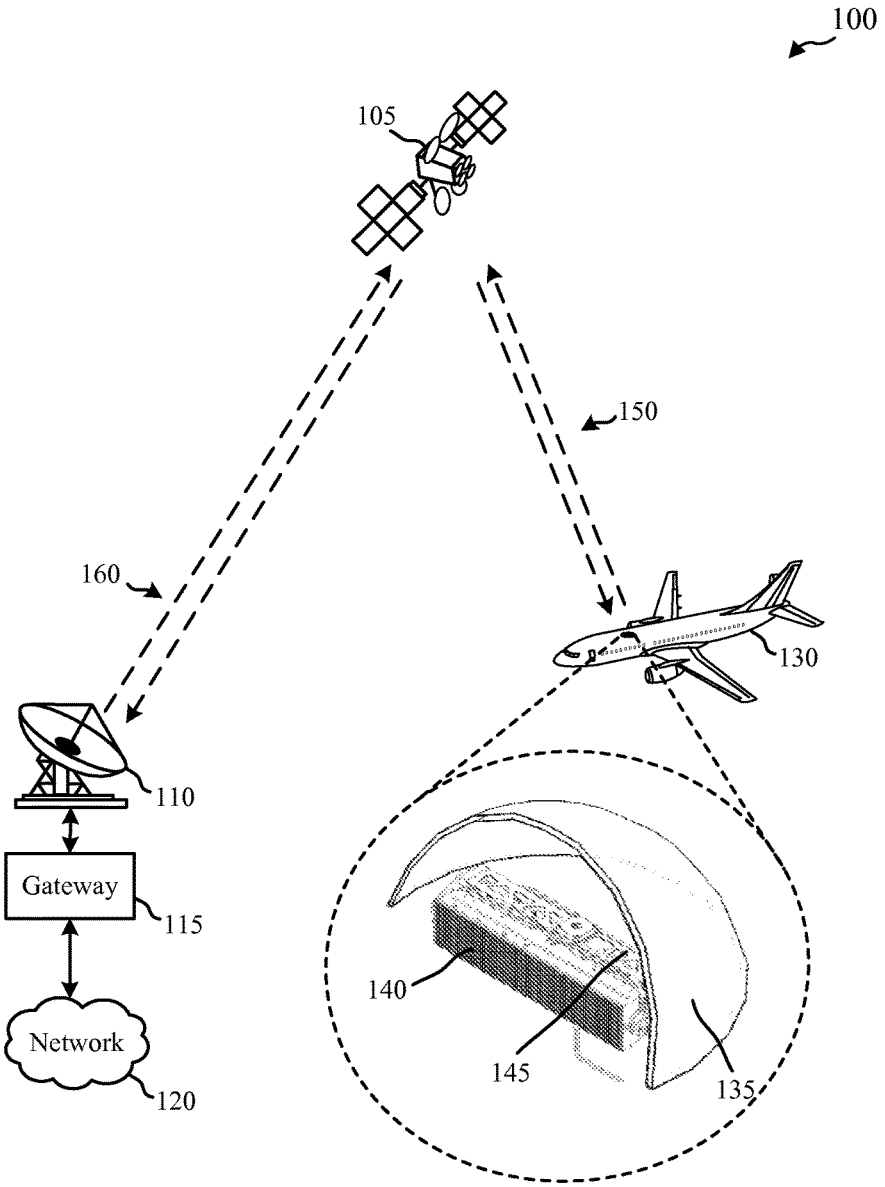
FIG. 1 shows a diagram of a satellite communication system in accordance with various aspects of the present disclosure.

FIG. 1 shows a diagram of a satellite communication system 100 in accordance with various aspects of the present disclosure. The satellite communication system 100 includes a satellite 105, a gateway 115, a gateway antenna system 110, and an aircraft 130. The gateway 115 communicates with one or more networks 120. In operation, the satellite communication system 100 provides for two-way communications between the aircraft 130 and the network 120 through the satellite 105 and the gateway 115.

The satellite 105 may be any suitable type of communication satellite. In some examples, the satellite 105 may be in a geosynchronous orbit. In other examples, any appropriate orbit (e.g., low earth orbit (LEO), medium earth orbit (MEO), etc.) for satellite 105 may be used. The satellite 105 may be a multi-beam satellite configured to provide service for multiple service beam coverage areas in a predefined geographical service area. In some examples, the satellite communication system 100 includes multiple satellites 105.

The gateway antenna system 110 may be two-way capable and designed with adequate transmit power and receive sensitivity to communicate reliably with the satellite system 105. The satellite system 105 may communicate with the gateway antenna system 110 by sending and receiving signals through one or more beams 160. The gateway 115 sends and receives signals to and from the satellite system 105 using the gateway antenna system 110. The gateway 115 is connected to the one or more networks 120. The networks 120 may include a local area network (LAN), metropolitan area network (MAN), wide area network (WAN), or any other suitable public or private network and may be connected to other communications networks such as the Internet, telephony networks (e.g., Public Switched Telephone Network (PSTN), etc.), and the like.

The aircraft 130 includes an on-board communication system including a dual-polarized antenna 140. The aircraft 130 may use the dual-polarized antenna 140 to communicate with the satellite 105 over one or more beams 150. The dual-polarized antenna 140 may be mounted on the outside of the fuselage of aircraft 130 under a radome 135. The dual-polarized antenna 140 may be mounted to a positioner 145 used to point the dual-polarized antenna 140 at the satellite 105 (e.g., actively tracking) during operation. The dual-polarized antenna 140 may be used for receiving communication signals from the satellite 105, transmitting communication signals to the satellite 105, or bi-directional communication with the satellite 105 (transmitting and receiving communication signals). The dual-polarized antenna 140 may operate in the International Telecommunications Union (ITU) Ku, K, or Ka-bands, for example from approximately 17 to 31 Giga-Hertz (GHz). Alternatively, the antenna 140 may operate in other frequency bands such as C-band, X-band, S-band, L-band, and the like.

The on-board communication system of the aircraft 130 may provide communication services for communication devices of the aircraft 130 via a modem (not shown). Communication devices may connect to and access the networks 120 through the modem. For example, mobile devices may communicate with one or more networks 120 via network connections to modem, which may be wired or wireless. A wireless connection may be, for example, of a wireless local area network (WLAN) technology such as IEEE 802.11 (Wi-Fi), or other wireless communication technology.

The size of the dual-polarized antenna 140 may directly impact the size of the radome 135, for which a low profile may be desired. In other examples, other types of housings are used with the dual-polarized antenna 140. Additionally, the dual-polarized antenna 140 may be used in other applications besides onboard the aircraft 130, such as onboard boats, vehicles, or on ground-based stationary systems.

For antennas using multiple waveguide elements for radiating and receiving energy, the operational frequency range of the antenna may be determined by the dimensions of each of the waveguide elements and the inter-element distance (distance from center-to-center of adjacent waveguide elements). For example, a lower cutoff frequency for each antenna element may be dependent on the cross-sectional dimensions of the waveguide element serving as a port between the antenna element and the transmission medium. Generally, as the operational frequency approaches the lower cutoff frequency, the efficiency of signal propagation decreases. To provide grating lobe free operation, the inter-element distance should be small relative to the desired operational frequency range (e.g., an inter-element distance less than or equal to one wavelength at the highest operating frequency for a non-electrically steered antenna, etc.). To provide efficient operation across the operational frequency range, it may be desirable to feed a large number of antenna elements using continuous waveguide combiner/divider networks (e.g., with no changes in propagation medium). These waveguide combiner/divider networks may be complex and may include several stages that extend back behind the aperture plane of the antenna, increasing the depth of the antenna dramatically as the array size increases. In some applications, the depth of the antenna may be constrained by a physical enclosure (e.g., radome 135, etc.), and thus the overall size of the antenna elements and waveguide combiner/divider networks may limit the number of antenna elements that can be used, thus limiting performance of the antenna.

Figure 2:
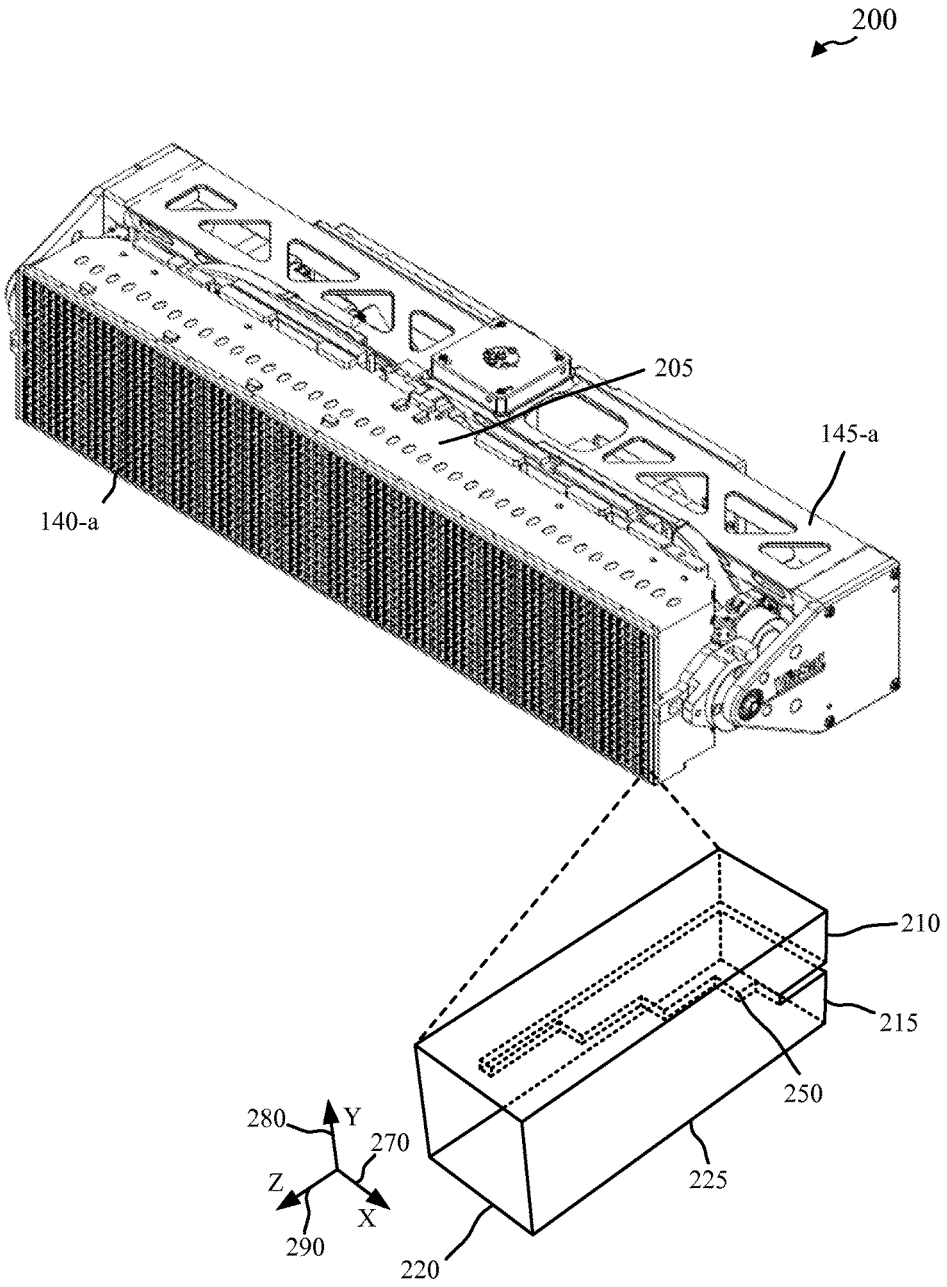
FIG. 2 shows a view of an antenna assembly in accordance with various aspects of the present disclosure.

FIG. 2 shows a view of an antenna assembly 200 in accordance with various aspects of the present disclosure. As shown in FIG. 2, antenna assembly 200 includes dual-polarized antenna 140-*a* and positioner 145-*a*, which may be, for example, the dual-polarized antenna 140 and positioner 145 illustrated in FIG. 1. Dual-polarized antenna 140-*a* includes multiple antenna elements 225, which may be arranged (e.g., in an array, etc.) to provide a beam forming network. One antenna element 225 is shown in greater detail with reference to an X-axis 270, Y-axis 280, and Z-axis 290.

Each antenna element 225 may include an individual waveguide 220 for emitting and receiving waves and a polarizer. The polarizer can convert a signal between dual polarization states in the individual waveguide 220 and two signal components in respective divided waveguides 210 and 215 that correspond to orthogonal basis polarizations. This facilitates simultaneous dual-polarized operation. For example, from a receive perspective, the polarizer can be thought of as receiving a signal in the individual waveguide 220, taking the energy corresponding to a first basis polarization of the signal and substantially transferring it into a first divided waveguide 210, and taking the energy corresponding to a second basis polarization of the signal and substantially transferring it into a second divided waveguide 215. From a transmit perspective, excitations of the first divided waveguide 210 results in energy of the first basis polarization being emitted from the individual waveguide 220 while the energy from excitations of the second divided waveguide 215 results in energy of the second basis polarization being emitted from the individual waveguide 220.

The polarizer may include an element that is asymmetric to one or more modes of signal propagation. For example, the polarizer may include a septum 250 configured to be symmetric to the $TE_{10}$ mode (e.g., component signals with their E-field along Y-axis 280 in individual waveguide 220) while being asymmetric to the $TE_{01}$ mode (e.g., component signals with their E-field along X-axis 270 in individual waveguide 220). The septum 250 may facilitate rotation of the $TE_{01}$ mode without changing signal amplitude, which may result in addition and cancellation of the $TE_{01}$ mode with the $TE_{10}$ mode on opposite sides of the septum 250. From the dividing perspective (e.g., a received signal propagating in the individual waveguide 220 in the negative Z-direction), the $TE_{01}$ mode may additively combine with the $TE_{10}$ mode for a signal having right hand circular polarization (RHCP) on the side of the septum 250 coupled with the first divided waveguide 210, while cancelling on the side of the septum 250 coupled with the second divided waveguide 215. Conversely, for a signal having left hand circular polarization (LHCP), the $TE_{01}$ mode and $TE_{10}$ mode may additively combine on the side of the septum 250 coupled with the second divided waveguide 215 and cancel each other on the side of the septum 250 coupled with the first divided waveguide 210. Thus, the first and second divided waveguides 210, 215 may be excited by orthogonal basis polarizations of polarized waves incident on the individual waveguide 220, and may be isolated from each other. In a transmission mode, excitations of the first and second divided waveguides 210, 215 (e.g., $TE_{10}$ mode signals) may result in corresponding RHCP and LHCP waves, respectively, emitted from the individual waveguide 220.

The polarizer may be used to transmit or receive waves having a combined polarization (e.g., linearly polarized signals having a desired polarization tilt angle) at the individual waveguide 220 by changing the relative phase of component signals transmitted or received via the first and second divided waveguides 210, 215. For example, two equal-amplitude components of a signal may be suitably phase shifted and sent separately to the first divided waveguide 210 and the second divided waveguide 215, where they are converted to an RHCP wave and an LHCP wave at the respective phases by the septum 250. When emitted from the individual waveguide 220, the LHCP and RHCP waves combine to produce a linearly polarized wave having an orientation at a tilt angle related to the phase shift introduced into the two components of the transmitted signal. The transmitted wave is therefore linearly polarized and can be aligned with a polarization axis of a communication system. Similarly, a wave having a combined polarization (e.g., linear polarization) incident on individual waveguide 220 may be split into component signals of the basis polarizations at the divided waveguides 210, 215 and recovered by suitable phase shifting of the component signals in a receiver. Although the polarizer is illustrated as a stepped septum polarizer, other types of polarizers may be used including sloped septum polarizers or other polarizers.

The antenna element 225 may operate over one or more frequency bands, and may operate in a uni-directional (transmit or receive) mode or in a bi-directional (transmit and receive) mode. For example, the antenna element may be used to transmit and/or receive a dual-band signal is characterized by operation using two signal carrier frequencies. In some instances, the antenna element 225 may operate in a transmission mode for a first polarization (e.g., LHCP, first linear polarization) while operating in a reception mode for a second, orthogonal polarization in the same or a different frequency band.

The multiple antenna elements 225 include waveguide networks (discussed in more detail below) that can provide for a small inter-element distance relative to the operating frequency range which can reduce or eliminate grating lobes. Furthermore, the described waveguide networks improve efficiency by coupling common feed ports to the divided waveguides 210, 215 of multiple antenna elements 225 using continuous waveguide signal paths without changes in transmission medium. The described waveguide networks may include ridged waveguide components and/or non-ridged waveguide components. In addition, the described waveguide networks can maintain equal path lengths between waveguide networks feeding each divided waveguide 210, 215 for the antenna elements 225. In aspects, the waveguide feed networks include initial combiner/divider stages connected to the antenna elements 225 that route waveguide signal paths from divided waveguides 210, 215 of a set of antenna elements 225 to a common port within a projection of a cross-sectional boundary of the set of antenna elements 225 while maintaining a desired (e.g., small) inter-element distance between antenna elements 225. These techniques provide a scalable architecture for connecting divided waveguides of multiple antenna elements using continuous waveguide signal paths.

In embodiments of the dual-polarized antennas 140 of FIGS. 1 and 2, the antenna elements 225 are arranged in unit cells, where each unit cell includes multiple antenna elements 225 having individual polarizers. The antenna elements 225 may be in an array configuration in the unit cell (e.g., 2×2 array, etc.) and a transverse (e.g., in the X-Y-plane) cross section of the antenna elements may define a unit cell boundary having a rectangular (e.g., square) or polygonal shape. Each unit cell may include a first waveguide network that connects each of the divided waveguides 210 of the antenna elements 225 of the unit cell associated with the first basis polarization to a first unit cell common waveguide and a second waveguide network that connects each of the divided waveguides 215 associated with the second basis polarization to a second unit cell common waveguide, via continuous waveguide signal paths. Each unit cell may be configured to have waveguide elements of the first waveguide network and the second waveguide network within a prism formed by extruding the unit cell boundary towards the unit cell common waveguides (e.g., in the negative Z-direction). The unit cells may then be arranged and the first and second unit cell common waveguides may be connected to a waveguide network 205 that may include multiple combiner/divider stages to connect the unit cells to waveguide ports of the dual-polarized antenna 140-*a* associated with the first and second basis polarizations.

The positioner 145-*a* may include an elevation motor and gearbox, an elevation alignment sensor, an azimuth motor and gearbox, and an azimuth alignment sensor. These components may be used to point the dual-polarized antenna 140-*a* at the satellite (e.g., satellite 105 in FIG. 1) during operation.

Figure 3:
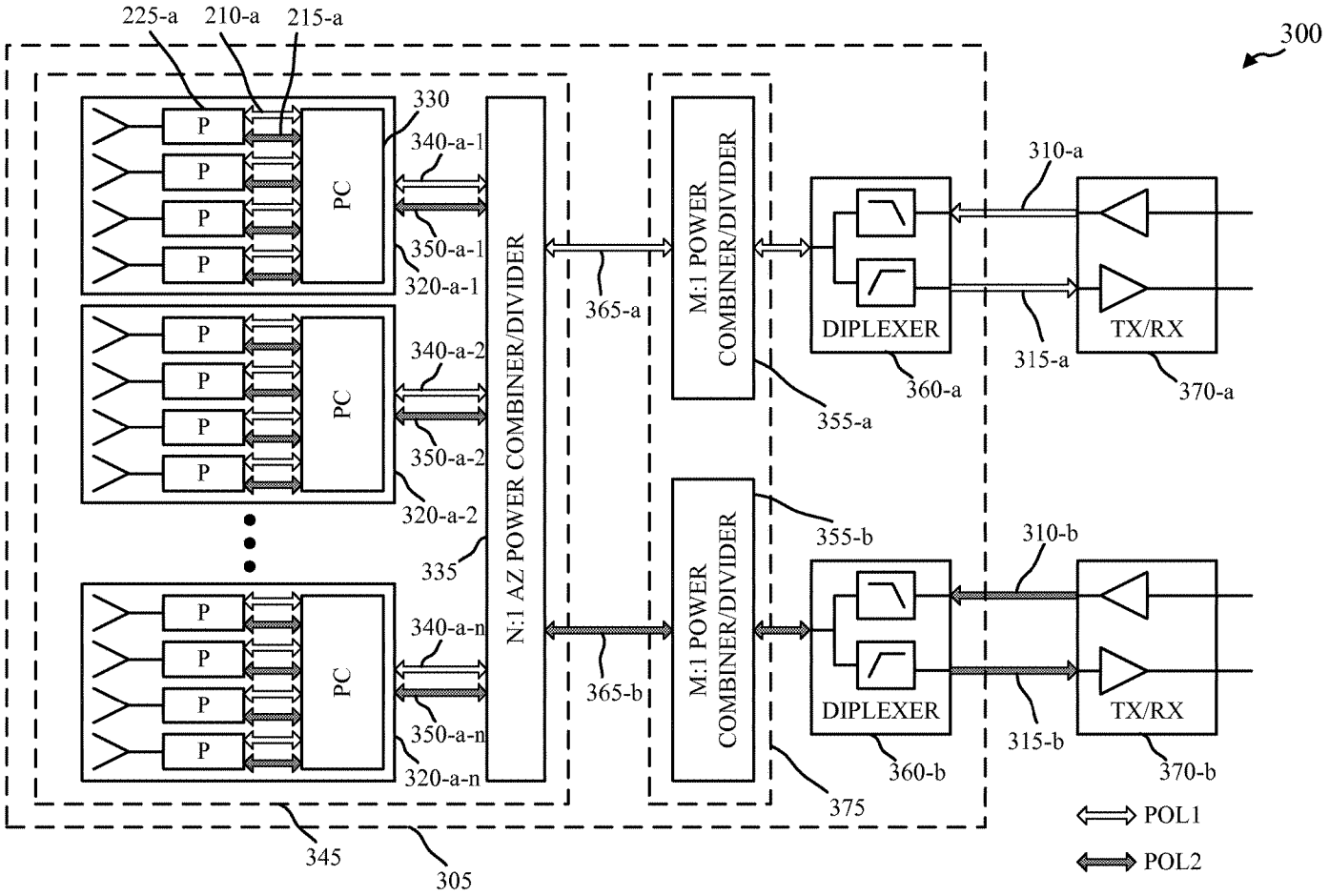
FIG. 3 shows a block diagram of an example antenna subsystem for a dual polarized antenna array in accordance with various aspects of the present disclosure.

FIG. 3 shows a block diagram of an example antenna subsystem 300 for a dual-polarized antenna in accordance with various aspects of the present disclosure. The antenna subsystem 300 may be an example of a component of the dual-polarized antennas 140 of FIG. 1 or FIG. 2, or may be used with other devices or systems.

The antenna subsystem 300 includes a waveguide device 305, which may have multiple waveguide networks associated with first and second basis polarizations coupled with multiple polarizers. In the antenna subsystem 300 as illustrated in FIG. 3, waveguide device 305 includes transmission port 310-*a* and reception port 315-*a* associated with a first basis polarization POL1 and transmission port 310-*b* and reception port 315-*b* associated with a second basis polarization POL2. The waveguide device 305 may include diplexers 360 for operation over different frequency ranges in transmission and reception modes. For example, a first frequency range may be used for transmission of signals from the antenna while a second, higher frequency range may be used for signals received at the antenna.

The waveguide device 305 includes an elevation combiner/divider stage 375, which may include an elevation power combiner/divider network 355 associated with each polarization. For example, elevation combiner/divider stage 375 may include a first elevation power combiner/divider network 355-*a* associated with POL1 and a second elevation power combiner/divider network 355-*b* associated with POL2. Each of the elevation power combiner/divider networks 355 may be an M:1 combiner/divider network including an elevation stage common port and M elevation ports 365. Thus, the first elevation power combiner/divider network 355-*a* may have M elevation ports 365-*a* associated with POL1 and the second elevation power combiner/divider network 355-*b* may have M elevation ports 365-*b* associated with POL2. The elevation power combiner/divider networks 355 may be of the corporate type and may include equal (e.g., substantially equal to manufacturing tolerances) waveguide path lengths (e.g., equal phases) between the elevation stage common port and each of the M elevation ports.

The waveguide device 305 includes M azimuth combiner/divider stages 345, each coupled with one set of the M elevation ports 365. Each azimuth combiner/divider stage 345 includes an N:1 azimuth combiner/divider 335 for each basis polarization and N unit cells 320-*a* (e.g., unit cells 320-*a*-1, 320-*a*-2, . . . , 320-*a*-*n*, etc.). The azimuth combiner/divider 335 may be of the corporate type and may include substantially equal waveguide path lengths (e.g., equal phases) between the elevation port 365 for each basis polarization and each of the common waveguides 340-*a*, 350-*a* for the N unit cells 320-*a* (e.g., common waveguides 340-*a*-1, 350-*a*-1 for unit cell 320-*a*-1, etc.).

Each unit cell 320-*a* may include A antenna elements 225-*a* (only one antenna element is labeled in FIG. 3 for clarity). Thus, each of the M azimuth combiner/divider stages 345 may include A·N antenna elements 225-*a*, which may each include a polarizer (e.g., septum polarizer) and individual waveguide for radiating/receiving energy. The A antenna elements 225-*a* of each unit cell 320-*a* may be arranged in a sub-array (e.g., 2×2, etc.). Each unit cell 320-*a* may include an A:1 power combiner/divider 330 (only one of which is labeled in FIG. 3 for clarity), which may provide equal power combining/dividing for each basis polarization between the antenna elements 225-*a* and unit cell common waveguides 340-*a*, 350-*a*.

Thus, each azimuth combiner/divider stage 345 may include N sub-arrays of A antenna elements. The waveguide device 305 may therefore include M·N·A antenna elements 225-*a*. In some cases, however, some azimuth combiner/divider stages 345 may include less than N unit cells 320-*a*. For example, to reduce the swept profile of the antenna subsystem 300, some of the azimuth combiner/divider stages 345 (e.g., towards the top and/or bottom) may include fewer unit cells 320-*a*, resulting in a taper or rounding of the corners of the waveguide device 305 that reduces the size of a radome used for the dual-polarized antenna.

The unit cells 320-*a* may be configured with a small inter-element distance (e.g., less than or equal to one wavelength at the highest operating frequency, etc.) between antenna elements 225-*a* and may be configured to be placed adjacent to other unit cells 320-*a* such that antenna elements 225-*a* of adjacent unit cells 320-*a* have the same inter-element distance between each other as antenna elements 225-*a* within each unit cell 320-*a*. This allows row/column scalability of the waveguide device 305 as the unit cells 320-*a* can be arranged in an arbitrary array size without changing the unit cell design.

The antenna subsystem 300 includes one or more transceivers 370 for bi-directional operation. The transceiver(s) convert electrical signals between an electrically conductive medium and a waveguide medium. The antenna subsystem 300 may be capable of full duplex operation. In some cases, the antenna subsystem 300 may include a single transceiver and may have predetermined polarization directionality (e.g., POL1 for transmission and POL2 for reception). As illustrated in FIG. 3, antenna subsystem 300 includes two transceivers and may be switched between using POL1 for transmission and POL2 for reception and using POL2 for transmission and POL1 for reception.

Figure 4:
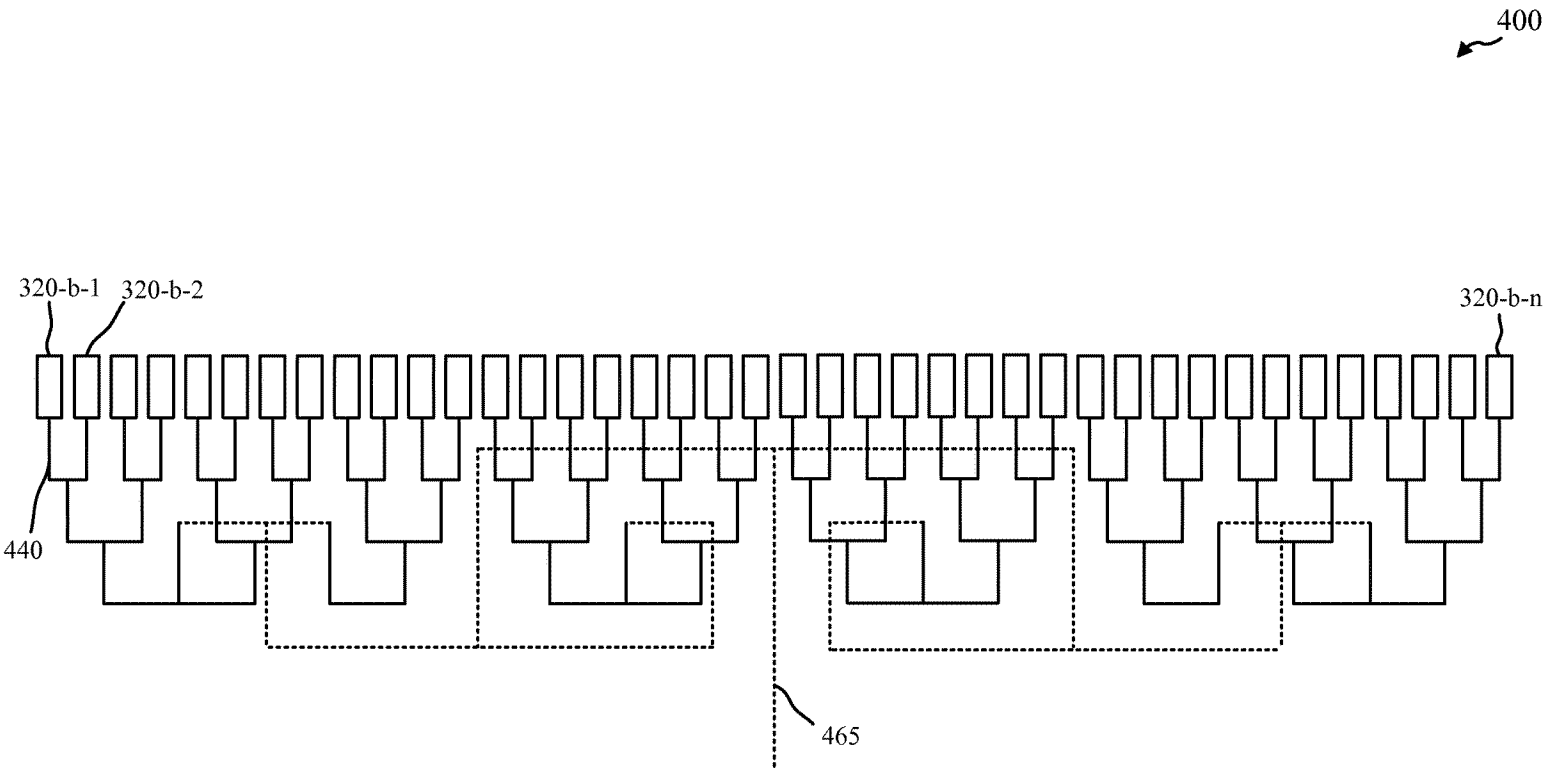
FIG. 4 shows a conceptual diagram of an example waveguide network for an azimuth combiner/divider stage in accordance with various aspects of the present disclosure.

FIG. 4 shows a conceptual diagram of an example waveguide network 400 for an azimuth combiner/divider stage in accordance with various aspects of the present disclosure. FIG. 4 illustrates an example waveguide network for a 40:1 azimuth combiner/divider stage for a basis polarization of a dual-polarized antenna, which may be an example of aspects of one or more of the azimuth combiner/divider stages 345 of FIG. 3. For simplicity and clarity, paths of the illustrated waveguide network 400 in FIG. 4 are not drawn to scale. Although a 40:1 waveguide network is illustrated in FIG. 4, other configurations are possible using a similar waveguide network architecture.

As shown in FIG. 4, the waveguide network 400 for an azimuth combiner/divider stage may be of the corporate type and may include multiple stages of waveguide combiner/dividers between an elevation port 465 associated with a basis polarization and waveguides 440 connected to the unit cell common waveguides (e.g., common waveguides 340-*a* or 350-*a* of FIG. 3) of the unit cells 320-*b*-1, 320-*b*-2, . . . , 320-*b*-*n*. Although not drawn to scale, it can be seen in FIG. 4 that waveguide network 400 can provide equal (e.g., substantially equal to manufacturing tolerances) waveguide path lengths between elevation port 465 and each waveguide 440.

Waveguide network 400 may illustrate the waveguide network for basis polarization POL1 for an azimuth combiner/divider stage 345 of FIG. 3, connecting elevation port 365-*a* to unit cell common waveguides 340-*a* of unit cells 320-*a*. The azimuth combiner/divider stage 345 of FIG. 3 may include two waveguide networks 400 that may be configured to have waveguide elements within an assembly having a height of the unit cells 320-*a*. Thus, the azimuth combiner/divider stages 345 of FIG. 3 may be stacked to provide an assembly that is scalable in elevation for different configurations.

Figure 5:
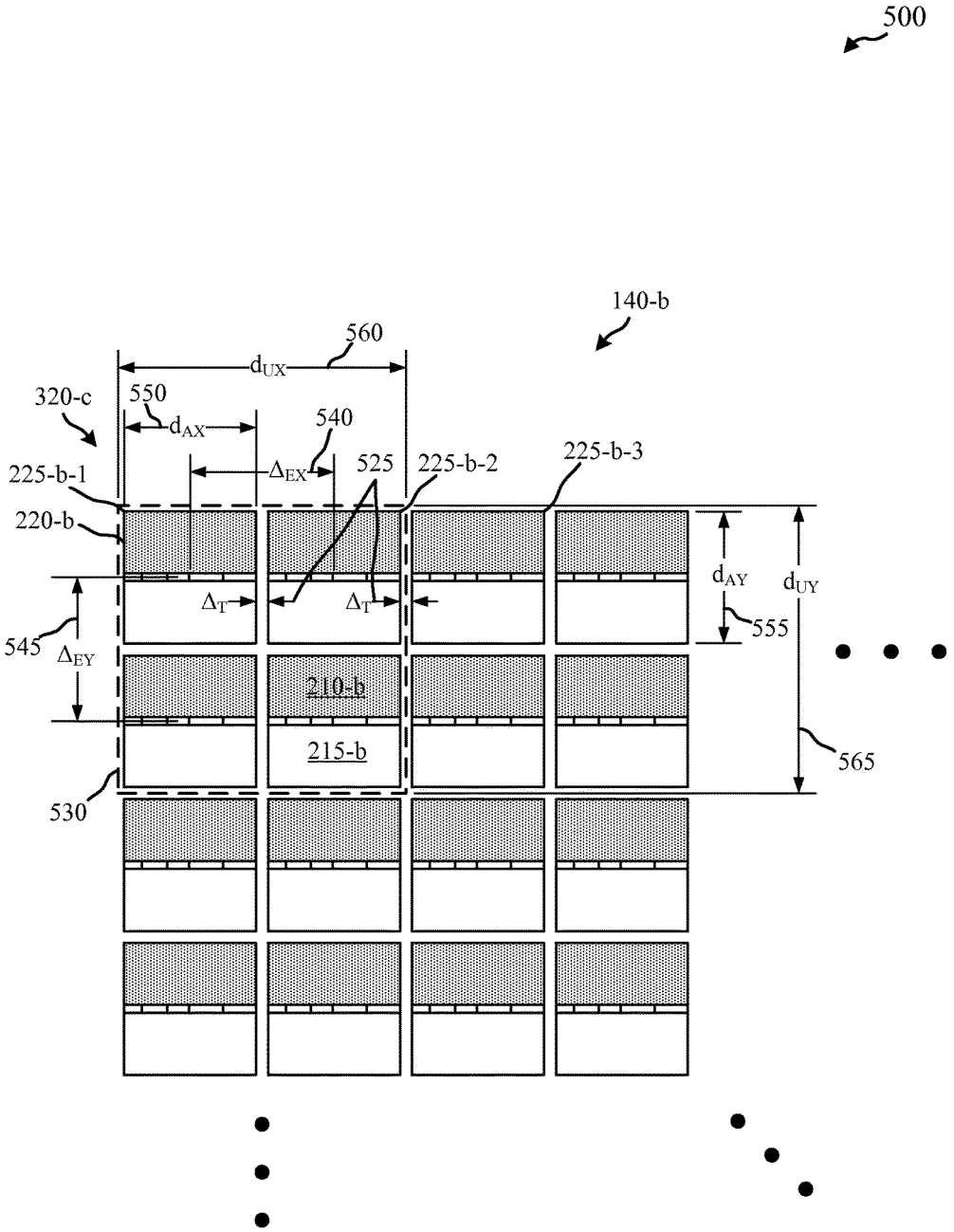
FIG. 5 shows a diagram of a front view of a dual polarized antenna in accordance with various aspects of the present disclosure.

FIG. 5 shows a diagram of a front view 500 of a dual-polarized antenna 140-*b* in accordance with various aspects of the present disclosure. The dual-polarized antenna 140-*b* may be an example of dual-polarized antennas 140 of FIG. 1 or 2. The dual-polarized antenna 140-*b* includes multiple antenna elements 225-*b*, of which only a subset are labeled for clarity. The antenna elements 225-*b* may be arranged in unit cells 320-*c*, which may include a waveguide network between common waveguides associated with two basis polarizations and the antenna elements 225-*b*. The unit cells 320-*c* may be arranged (e.g., in an array, etc.) to create a beamforming network of antenna elements 225-*b* for transmitting and/or receiving signals.

Each antenna element 225-*b* may have an individual waveguide 220-*b* with a rectangular cross-section. For efficiency and performance, each individual waveguide 325 may support dual-polarized operation. For example, when a signal is transmitted via dual-polarized antenna 140-*b* using a first polarization, it may be desired that all individual waveguides 220-*b* in the antenna 140-*b* are part of the beamforming network transmitting the signal. Similarly, when a signal wave is received by dual-polarized antenna 140-*b* of the same polarization or a different (e.g., orthogonal) polarization, it may be desired that energy received by all individual waveguides 220-*b* is combined in the beamforming network for the received signal power. In some cases, each individual waveguide 220-*b* may transmit energy using a first polarization and receive energy of a second (e.g., orthogonal) polarization concurrently. Each antenna element 225-*b* may include a polarizer and divided waveguides 210-*b*, 215-*b* associated with each basis polarization, of which only one antenna element 225-*b* has the divided waveguides 210-*b*, 215-*b* labeled for clarity.

The individual waveguides 220-*b* may have inter-element distances $\Delta_{EX}$ 540 and $\Delta_{EY}$ 545, which may be related to the desired operational frequency range and may be equal to each other. For example, $\Delta_{EX}$ 540 and $\Delta_{EY}$ 545 may be related to the wavelength at the highest operating frequency (e.g., to provide grating lobe free operation at the highest operating frequency, etc.). Each individual waveguide 220-*b* shares waveguide walls with at least two other individual waveguides 220-*b*, and the individual waveguides 220-*b* may have a width $d_{AX}$ 550 and height $d_{AY}$ 555, which may be determined by the inter-element distances $\Delta_{EX}$ 540 and $\Delta_{EY}$ 545 and a thickness $\Delta_T$ 525 of the waveguide walls that is sufficient for structural integrity of the individual waveguides 220-*b*. In addition, the individual waveguides 220-*b* of adjacent antenna elements 225-*b* of adjacent unit cells 320-*c* share waveguide walls with each other.

Each unit cell 320-*c* may be a quad-element unit cell having a 4:1 power combiner/divider ratio for each basis polarization between the divided waveguides 210-*b*, 210-*c* of the antenna elements 225-*b* and common waveguides associated with each of the basis polarizations. The antenna elements 225-*b* may have inter-element distances $\Delta_{EX}$ 540 and $\Delta_{EY}$ 545, which may be the same distance for adjacent antenna elements 225-*b* within the same unit cell 320-*c* and for adjacent antenna elements 225-*b* that belong to adjacent unit cells 320-*c*. For example, the inter-element distance $\Delta_{EX}$ 540 between antenna elements 225-*b*-1 and 225-*b*-2 may be the same as the inter-element distance $\Delta_{EX}$ 540 between antenna elements 225-*b*-2 and 225-*b*-3.

To achieve the same inter-element distances $\Delta_{EX}$ 540 and $\Delta_{EY}$ 545 between antenna elements across the dual-polarized antenna 140-*b*, each quad element unit cell 320-*c* may have a unit cell boundary 530 with width $d_{UX}$ 560 given by $d_{UX}=2\cdot\Delta_{EX}$, and height $d_{UY}$ 565 given by $d_{UY}=2\cdot\Delta_{EY}$, where $\Delta_{EX}$ 540 and $\Delta_{EY}$ 545 may be small relative to the operating frequency range (e.g., less than or equal to one wavelength at the highest operating frequency, etc.). Thus, each quad element unit cell 320-*c* may have 4:1 power combiner/divider waveguide networks that connect the divided waveguides 210-*b*, 215-*b* of the antenna elements 225-*b* to the common waveguides associated with each of the basis polarizations that are within a rectangular prism formed by a projection of the unit-cell boundary 530 in a direction normal to the cross-sectional plane of the unit cell boundary 530 (e.g., into the page in FIG. 5). In some examples, inter-element distances $\Delta_{EX}$ 540 and $\Delta_{EY}$ 545 may be the same and the individual waveguides 220-*b* may be square (e.g., $d_{UX}=d_{UY}$).

The wall thickness $\Delta_T$ 525 may be relatively small (e.g., less than 0.2, 0.15, or 0.1 of the inter-element distances $\Delta_{EX}$ 540 and $\Delta_{EY}$ 545, etc.). Thus, the ratio of the unit cell cross-sectional width $d_{UX}$ 560 or height $d_{UY}$ 565 to the individual waveguide width $d_{AX}$ 550 or height $d_{AY}$ 555, may be less than 2.5. However, the ratio may be different for different individual waveguide widths $d_{AX}$ 550 or heights $d_{AY}$ 555, and may generally be smaller for antenna elements 225-*b* supporting lower frequencies (e.g., having larger individual waveguides 220-*b*). In one embodiment, a quad-element unit cell with $d_{UX}=d_{UY}=0.735"$ and using ridged waveguides (e.g., as shown in FIGS. 8A-8D) has an operational bandwidth of approximately 17.5 to 31 GHz.

Figure 6A:
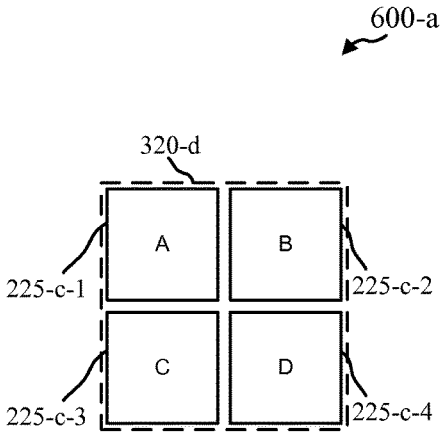
FIGS. 6A-6C show diagrams of an example quad element unit cell for a dual polarized antenna in accordance with various aspects of the present disclosure.

FIG. 6A shows a diagram 600-*a* of a front view of portions of an example quad element unit cell 320-*d* for a dual polarized antenna in accordance with various aspects of the present disclosure. The unit cell 320-*d* may be the unit cells 320 of FIG. 3, 4 or 5. The unit cell 320-*d* may include four antenna elements 225-*c*-1, 225-*c*-2, 225-*c*-3, and 225-*c*-4. The four antenna elements 225-*c* of unit cell 320-*c* may be arranged in rows and columns (e.g., 2×2 array, etc.).

Figure 6B:
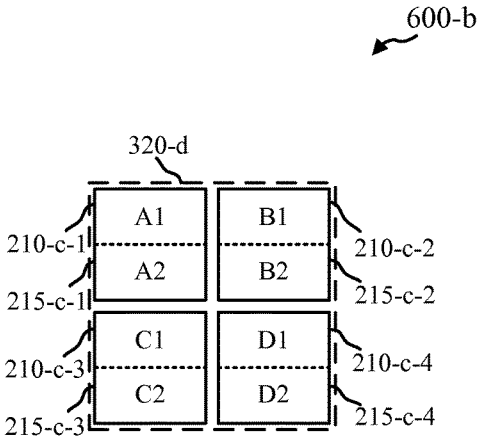

FIG. 6B shows a diagram 600-*b* of divided waveguides associated with basis polarizations POL1 and POL2 for the example quad element unit cell 320-*d* illustrated in FIG. 6A in accordance with various aspects of the disclosure. As illustrated in diagram 600-*b*, each antenna element 225-*c* may have a first divided waveguide 210-*c* associated with a first basis polarization POL1 and a second divided waveguide 215-*c* associated with a second basis polarization POL2. For clarity, the divided waveguides associated with POL1 may be referred to as divided waveguides A1 210-*c*-1, B1 210-*c*-2, C1 210-*c*-3, and D1 210-*c*-4 and the divided waveguides associated with POL2 may be referred to as divided waveguides A2 215-*c*-1, B2 215-*c*-2, C2 215-*c*-3, and D2 215-*c*-4.

Figure 6C:
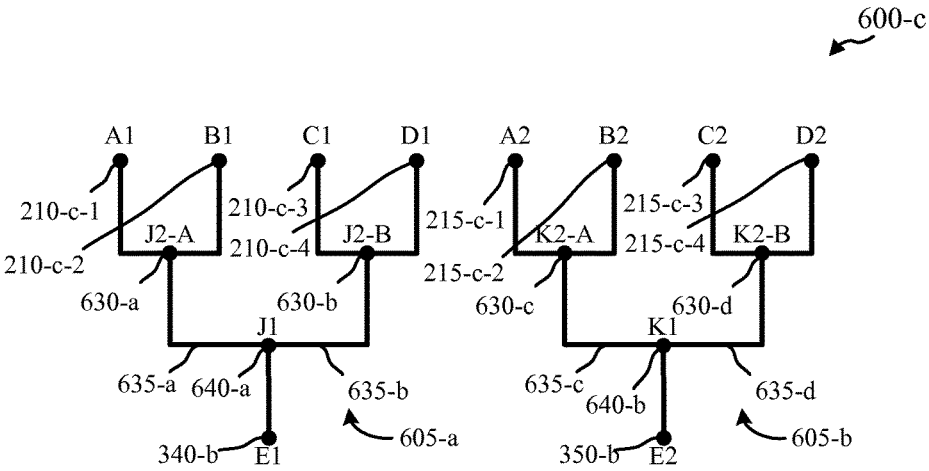

FIG. 6C shows a diagram 600-*c* of waveguide networks for the example quad element unit cell 320-*d* in accordance with various aspects of the disclosure. Diagram 600-*c* may illustrate waveguide networks for connecting divided waveguides 210-*c*, 215-*c* of antenna elements 225-*c* associated with first and second basis polarizations to first and second common waveguides, respectively.

As illustrated in diagram 600-*c*, unit cell 320-*d* may include a first waveguide network 605-*a* that includes multiple waveguide combiner/dividers and connects the divided waveguides A1 210-*c*-1, B1 210-*c*-2, C1 210-*c*-3, and D1 210-*c*-4 to a first common waveguide E1 340-*b* associated with POL1 via continuous waveguide signal paths. Unit cell 320-*d* may include a second waveguide network 605-*b* that includes multiple waveguide combiner/dividers and connects the divided waveguides A2 215-*c*-1, B2 215-*c*-2, C2 215-*c*-3, and D2 215-*c*-4 to a second common waveguide E2 350-*b* associated with POL2 via continuous waveguide signal paths.

The first waveguide network 605-*a* may include a first combiner/divider J1 640-*a*, which may be an E-plane combiner/divider (e.g., E-plane tee, E-plane septum, etc.). The first combiner/divider J1 640-*a* may divide the first common waveguide E1 340-*b* into intermediate waveguides 635-*a* and 635-*b*. The first waveguide network 605-*a* may include a set of second waveguide combiner/dividers J2-A 630-*a* and J2-B 630-*b* coupled between the intermediate waveguides 630-*a* and 635-*b* and the first divided waveguides 210-*c* of the antenna elements 225-*c*. The set of second waveguide combiner/dividers J2-A 630-*a* and J2-B 630-*b* may be E-plane or H-plane combiner/dividers.

Similarly, the second waveguide network 605-*b* may include a third combiner/divider K1 640-*b*, which may be an E-plane combiner/divider (e.g., E-plane tee, E-plane septum, etc.). The third combiner/divider K1 640-*b* may divide the first common waveguide E2 350-*b* into intermediate waveguides 635-*c* and 635-*d*. The first waveguide network 605-*b* may include a set of fourth waveguide combiner/dividers K2-A 630-*c* and K2-B 630-*d* coupled between the intermediate waveguides 630-*c* and 635-*d* and the second divided waveguides 215-*c* of the antenna elements 225-*c*. The set of fourth waveguide combiner/dividers K2-A 630-*c* and K2-B 630-*d* may be E-plane or H-plane combiner/dividers.

FIGS. 7A-7E show views of waveguides for a unit cell 320-*e* of a dual polarized antenna in accordance with various aspects of the present disclosure. Unit cell 320-*e* may be an example of the unit cells 320 of FIG. 3, 4, 5, 6A, 6B, or 6C.

Figure 7A:
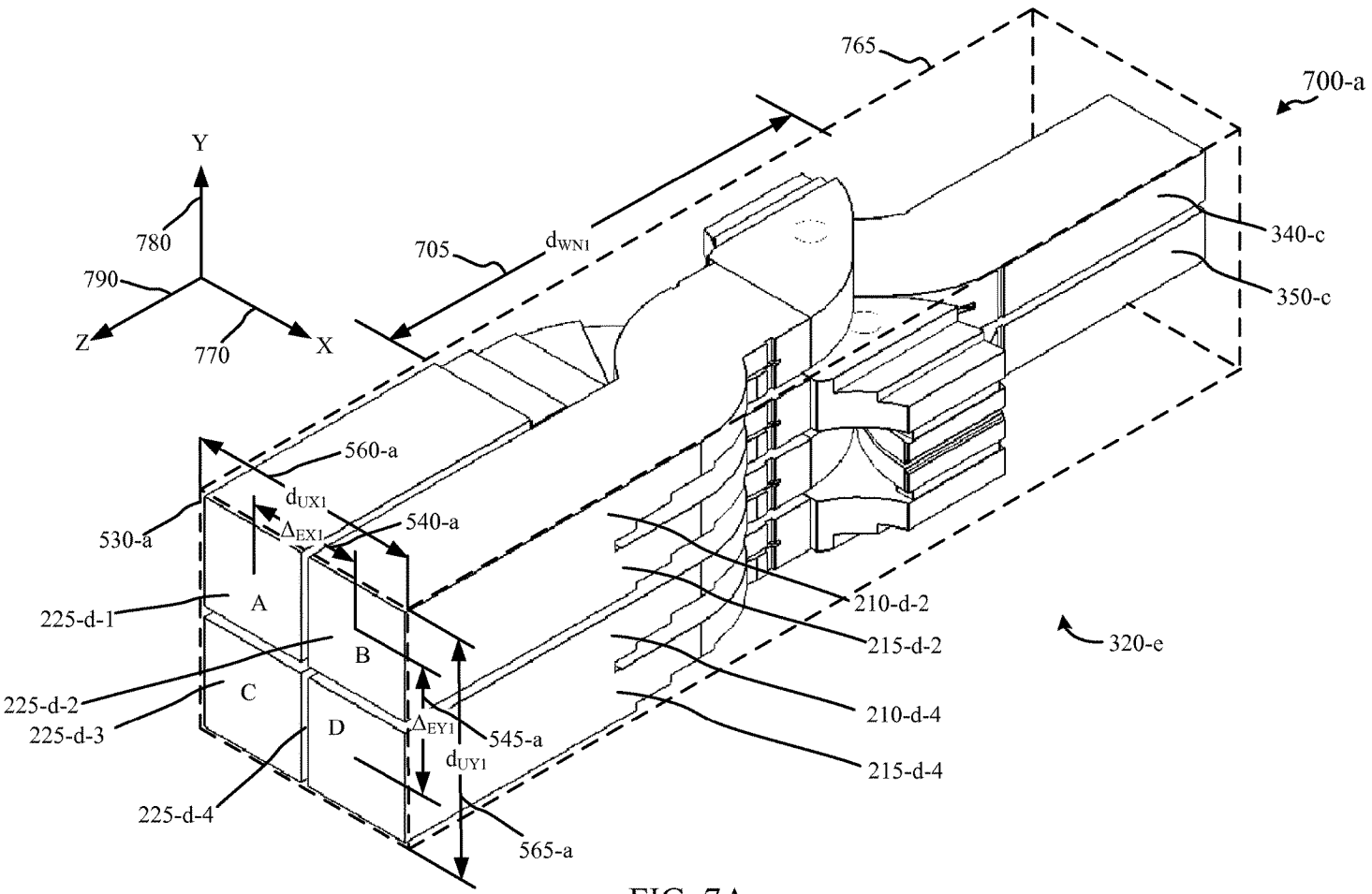
FIGS. 7A-7E show views of waveguides for a unit cell of a dual polarized antenna in accordance with various aspects of the present disclosure.

FIG. 7A shows an isometric view 700-*a* of waveguides for unit cell 320-*e*. As seen in FIG. 7A, unit cell 320-*d* may include antenna elements A 225-*d*-1, B 225-*d*-2, C 225-*d*-3, and D 225-*d*-4, which may define a unit cell boundary 530-*a* in a plane defined by the X-axis 770 and the Y-axis 780. The unit cell boundary 530-*a* may be rectangular (e.g., square) and may have a width $d_{UX1}$ 560-*a* and a height $d_{UY1}$ 565-*a*. Antenna elements 225-*d* may have inter-element distances $\Delta_{EX1}$ 540-*a* and $\Delta_{EY1}$ 545-*a* along the X-axis 770 and the Y-axis 780, respectively. Inter-element distances $\Delta_{EX1}$ 540-*a* and $\Delta_{EY1}$ 545-*a* may be small relative to the operating frequency range if the unit cell 320-*e* (e.g., less than or equal to one wavelength at the highest operating frequency, etc.).

Unit cell 320-*e* may include waveguide networks 705 connecting the divided waveguides 210-*d*, 215-*d* of antenna elements 225-*d* associated with first and second basis polarizations to a first common waveguide 340-*c* and a second common waveguide 350-*c*, respectively. Although illustrated in FIGS. 7A-7E as non-ridged waveguide, waveguide networks 705 may include ridged waveguide components, in some cases. The first common waveguide 340-*c* and the second common waveguide 350-*c* may be aligned in a first dimension (e.g., along the X-axis 770) and offset along a second dimension (e.g., along the Y-axis 780) with respect to each other.

Waveguide networks 705 may include multiple waveguide combiner/dividers which may be within a prism 765 formed by extruding or projecting the unit cell boundary 530-*a* along the Z-axis 790 without increasing the inter-element distances $\Delta_{EX1}$ 540-*a* and $\Delta_{EY1}$ 545-*a*. Thus, the waveguide networks 705 of unit cell 320-*e* provide for a 4:1 power combiner/divider stage that can be configured in an arrangement having the same inter-element distances $\Delta_{EX1}$ 540-*a* and $\Delta_{EY1}$ 545-*a* for adjacent antenna elements 225-*d* within the same unit cell 320-*e* and for adjacent antenna elements 225-*d* that belong to adjacent unit cells 320-*e*. Thus, a dual polarization antenna array of an appropriate or desired size may be constructed using waveguide networks to connect antenna waveguide ports to unit cell common waveguides.

Figure 7B:
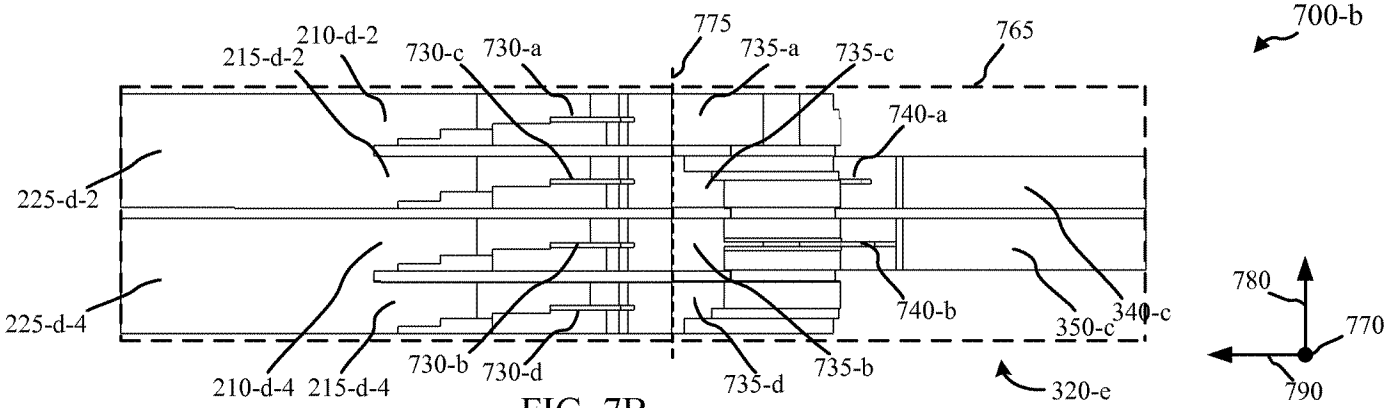

FIG. 7B shows a side view 700-*b* of waveguides for unit cell 320-*e*. As seen in side view 700-*b*, unit cell 320-*e* includes a first waveguide network that includes multiple waveguide combiner/dividers and connects the divided waveguides 210-*d* of antenna elements 225-*d* associated with a first basis polarization to the first common waveguide 340-*c* and a second waveguide network that includes multiple waveguide combiner/dividers and connects the divided waveguides 215-*d* of antenna elements 225-*d* associated with a second basis polarization to the second common waveguide 350-*c*.

The first waveguide network may include a combiner/divider 740-*a* dividing the first common waveguide 340-*c* into a first pair of intermediate waveguides 735-*a* and 735-*b*. The second waveguide network may include a combiner/divider 740-*b* dividing the second common waveguide 350-*c* into a second pair of intermediate waveguides 735-*c* and 735-*d*. In unit cell 320-*e*, the combiner/dividers 740-*a* and 740-*b* are E-plane combiner/dividers.

Figure 7C:
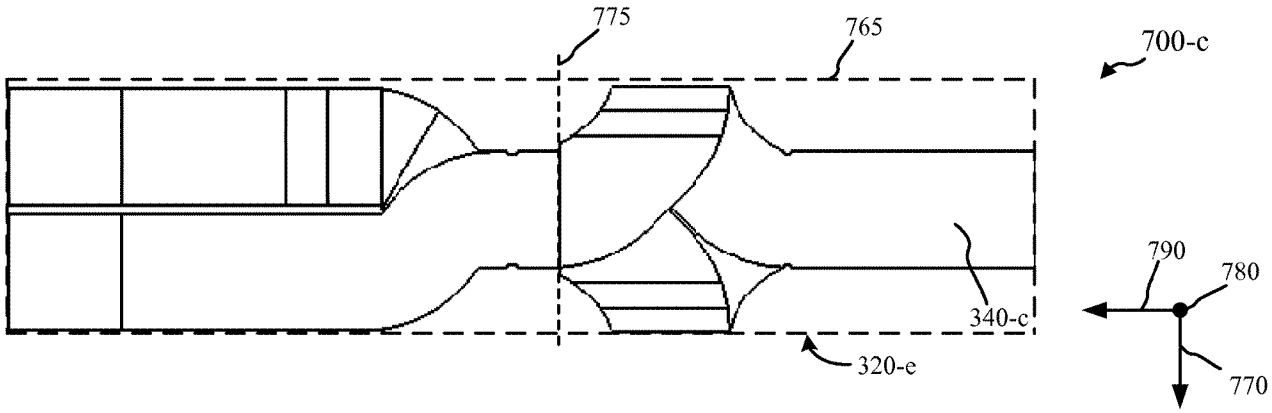

As can be seen in FIGS. 7A-7C, the first pair of intermediate waveguides 735-*a* and 735-*b* are interleaved in the Y-axis 780 with the second pair of intermediate waveguides 735-*c* and 735-*d* using a series of bend sections (e.g., E-plane bends, H-plane bends, etc.). In addition, transition regions may be used to transition the waveguide height back up to the same height (e.g., approximately or within manufacturing tolerances) as the common waveguides 340-*c* and 350-*c* at the X-Y section plane 775.

In the direction of increasing Z from X-Y section plane 775, waveguide combiner/divider 730-*a* is coupled between intermediate waveguide 735-*a* and the divided waveguides 210-*d* of antenna elements 225-*d*-1 and 225-*d*-2 associated with the first basis polarization and waveguide combiner/ divider 730-*b* is coupled between intermediate waveguide 735-*b* and the divided waveguides 210-*d* of antenna elements 225-*d*-3 and 225-*d*-4 associated with the first basis polarization. Similarly, waveguide combiner/divider 730-*c* is coupled between intermediate waveguide 735-*c* and the divided waveguides 215-*d* of antenna elements 225-*d*-1 and 225-*d*-2 associated with the second basis polarization and waveguide combiner/divider 730-*d* is coupled between intermediate waveguide 735-*d* and the divided waveguides 215-*d* of antenna elements 225-*d*-3 and 225-*d*-4 associated with the second basis polarization.

Additional H-plane bend sections and transition regions are used between the waveguide combiner/dividers 730 and the divided waveguides of the antenna elements 225-*d* to separate the waveguides in the H-plane and increase the waveguide height to match the height of the divided waveguides 210-*d*, 215-*d* at the antenna elements 225-*d*. The height of the divided waveguides 210-*d*, 215-*d* at the antenna elements 225-*d* may be approximately the same (e.g., approximately or within manufacturing tolerances) as the height of the corresponding common waveguide 340-*c* or 350-*c*.

Figure 7D:
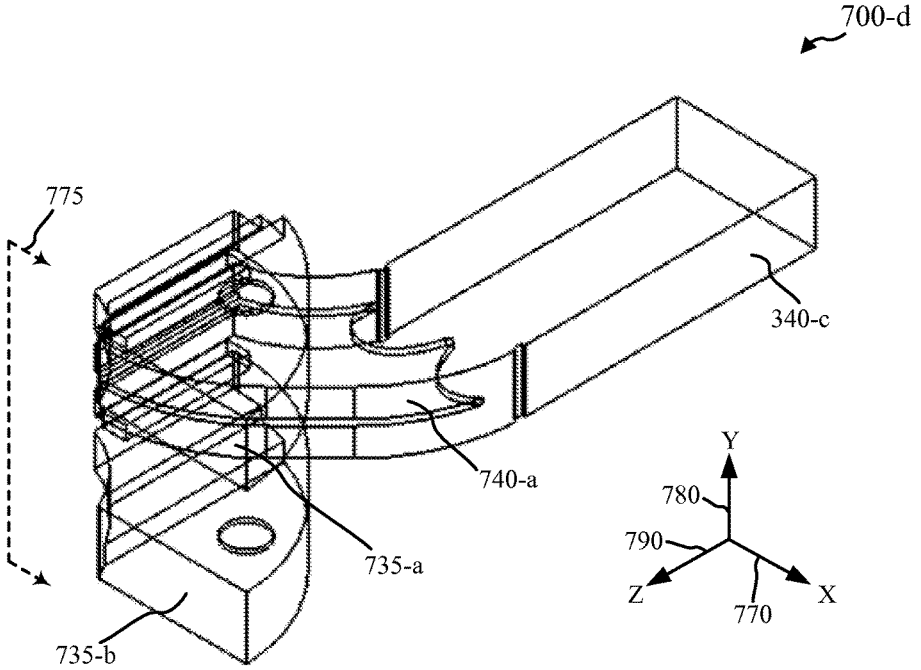

FIG. 7D shows an isometric view 700-*d* of the waveguide elements between the first common waveguide 340-*c* and the X-Y section plane 775 in more detail. As shown in view 700-*d*, waveguide combiner/divider 740-*a* divides the first common waveguide 340-*c* into the intermediate waveguides 735-*a* and 735-*b*.

As illustrated in FIG. 7D, intermediate waveguide 735-*a* starts at waveguide combiner/divider 740-*a* aligned with the Z-axis 790. From waveguide combiner/divider 740-*a*, the intermediate waveguide 735-*a* includes a first 90-degree H-plane bend section. The intermediate waveguide 735-*a* then includes a 180-degree E-plane bend section coupled with the first 90-degree H-plane bend section. The intermediate waveguide 735-*a* then includes a second 90-degree H-plane bend section between the 180-degree E-plane bend section and the section plane 775, which includes a transition region of increasing height such that the height of the intermediate waveguide 735-*a* at the X-Y section plane 775 is equal (e.g., approximately or within manufacturing tolerances) to the height of the common waveguide 340-*c*. As illustrated in FIGS. 7A-7E, intermediate waveguides 735-*b*, 735-*c* and 735-*d* each include similar structures as intermediate waveguide 735-*a*. It should be understood that descriptions of the 90-degree and 180-degree bend sections allow for manufacturing tolerances. That is, each of the bend sections may be substantially 90 or 180 degrees, within manufacturing tolerances.

Figure 7E:
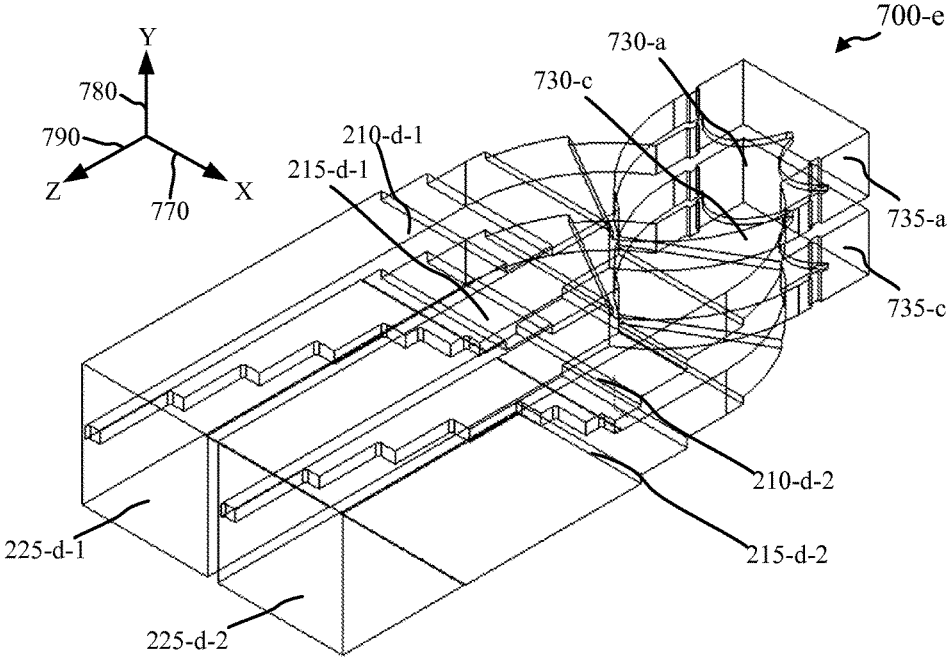

FIG. 7E shows an isometric view 700-*e* of the waveguide elements between the X-Y section plane 775 and the antenna elements A 225-*d*-1 and B 225-*d*-2. As illustrated in view 700-*e*, waveguide combiner/divider 730-*a* is coupled between intermediate waveguide 735-*a* and the divided waveguides 210-*d*-1 and 210-*d*-2 of antenna elements 225-*d*-1 and 225-*d*-2 associated with the first basis polarization, respectively, and waveguide combiner/divider 730-*c* is coupled between intermediate waveguide 735-*c* and the divided waveguides 215-*d*-1 and 215-*d*-2 of antenna elements 225-*d*-1 and 225-*d*-2 associated with the second basis polarization, respectively. Between waveguide combiner/dividers 730-*a* and 730-*c* and the divided waveguides 210-*d*, 215-*d* of antenna elements 225-*d*-1 and 225-*d*-2 are H-plane bend sections with transition regions increasing the waveguide height to the height of the divided waveguides, which may be the same (e.g., approximately or within manufacturing tolerances) as the height of the corresponding common waveguide 340-*c* or 350-*c*.

Returning to FIG. 7A, it can be seen that the waveguide structure of unit cell 320-*e* provides for a quad-element unit cell of antenna elements, where each antenna element includes a polarizer, that has waveguide networks 705 coupling each divided waveguide of the polarizers to common waveguides of the respective basis polarization. In addition, the waveguide networks 705 of unit cell 320-*e* may be compact in the Z-axis 790. For example, the waveguide networks 705 may have a depth $d_{WN1}$ that is less than 2.5 times the width $d_{UX1}$ 560-*a* or height $d_{UY1}$ 565-*a* of the unit cell cross-section 530-*a*.

FIGS. 8A-8D show views of waveguides for a unit cell 320-*f* of a dual polarized antenna in accordance with various aspects of the present disclosure. Unit cell 320-*f* may be an example of the unit cells 320 of FIG. 3, 4, 5, 6A, 6B, or 6C.

Figure 8A:
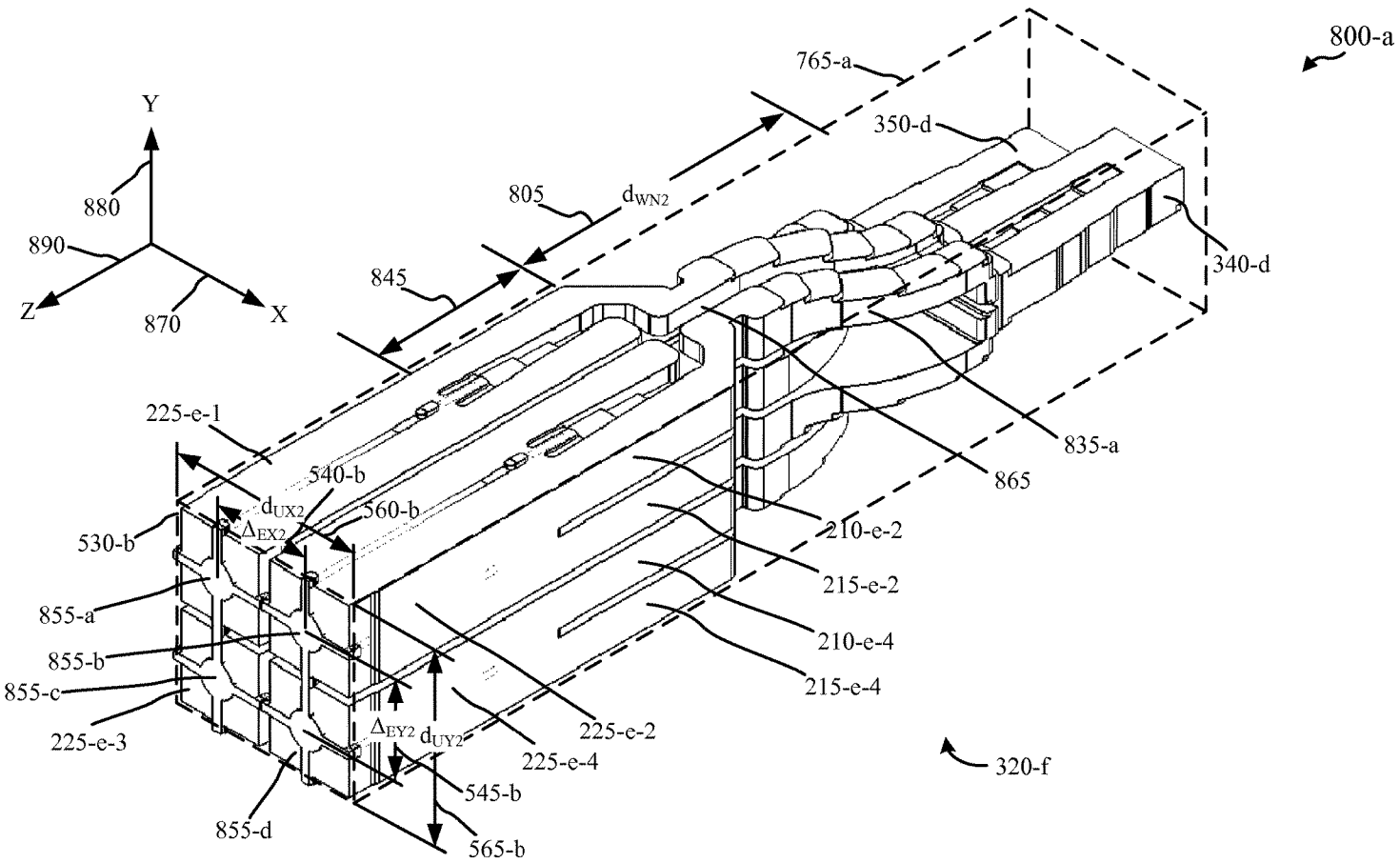
FIGS. 8A-8D show views of waveguides for a unit cell of a dual polarized antenna in accordance with various aspects of the present disclosure.

FIG. 8A shows an isometric view 800-*a* of waveguides for unit cell 320-*f*. As seen in FIG. 8A, unit cell 320-*f* may include antenna elements A 225-*e*-1, B 225-*e*-2, C 225-*e*-3, and D 225-*e*-4, which may have a unit cell boundary 530-*b* in a plane defined by the X-axis 870 and the Y-axis 880. The unit cell boundary 530-*b* may be rectangular (e.g., square) and may have a width $d_{UX2}$ 560-*b* and a height $d_{UY2}$ 565-*b*. Antenna elements 225-*e* may have inter-element distances $\Delta_{EX2}$ 540-*b* and $\Delta_{EY2}$ 545-*b* along the X-axis 870 and the Y-axis 880, respectively. Inter-element distances $\Delta_{EX2}$ 540-*b* and $\Delta_{EY2}$ 545-*b* may be small relative to the operating frequency range if the unit cell 320-*f* (e.g., less than or equal to one wavelength at the highest operating frequency, etc.).

Unit cell 320-*f* may include waveguide networks 805 connecting the divided waveguides 210-*e* of antenna elements 225-*e* associated with a first basis polarization to a first common waveguide 340-*d* and connecting the divided waveguides 215-*e* of antenna elements 225-*e* associated with a second basis polarization to a second common waveguide 350-*d*. The first common waveguide 340-*d* and the second common waveguide 350-*d* may be offset in two dimensions (e.g., along the X axis 870 and the Y-axis 880) with respect to each other.

Waveguide networks 805 may include multiple waveguide combiner/dividers which may be within a prism 765-*a* formed by extruding or projecting the unit cell boundary 530-*b* along the Z-axis 890. Thus, the waveguide networks 805 of unit cell 320-*f* provide for a 4:1 power combiner/divider stage that can be configured in an arrangement having the same inter-element distances $\Delta_{EX2}$ 540-*b* and $\Delta_{EY2}$ 545-*b* for adjacent antenna elements 225-*e* within the same unit cell 320-*f* and for adjacent antenna elements 225-*e* that belong to adjacent unit cells 320-*f* Thus, a dual-polarized antenna array of an appropriate or desired size may be constructed using waveguide networks to connect antenna waveguide ports to unit cell common waveguides.

Figure 8B:
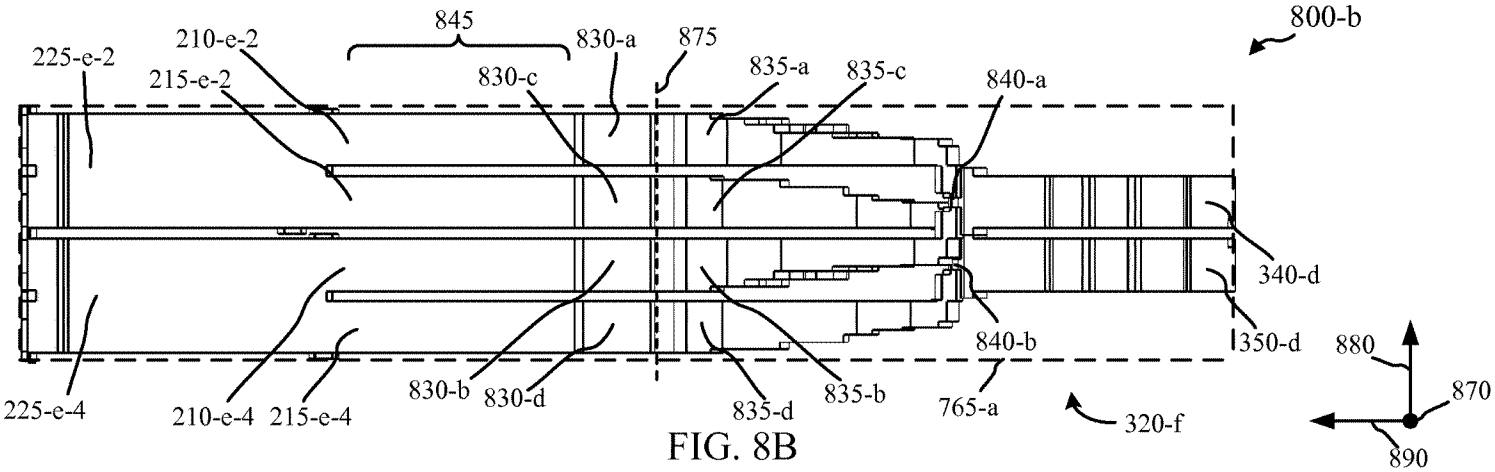
Figure 8C:
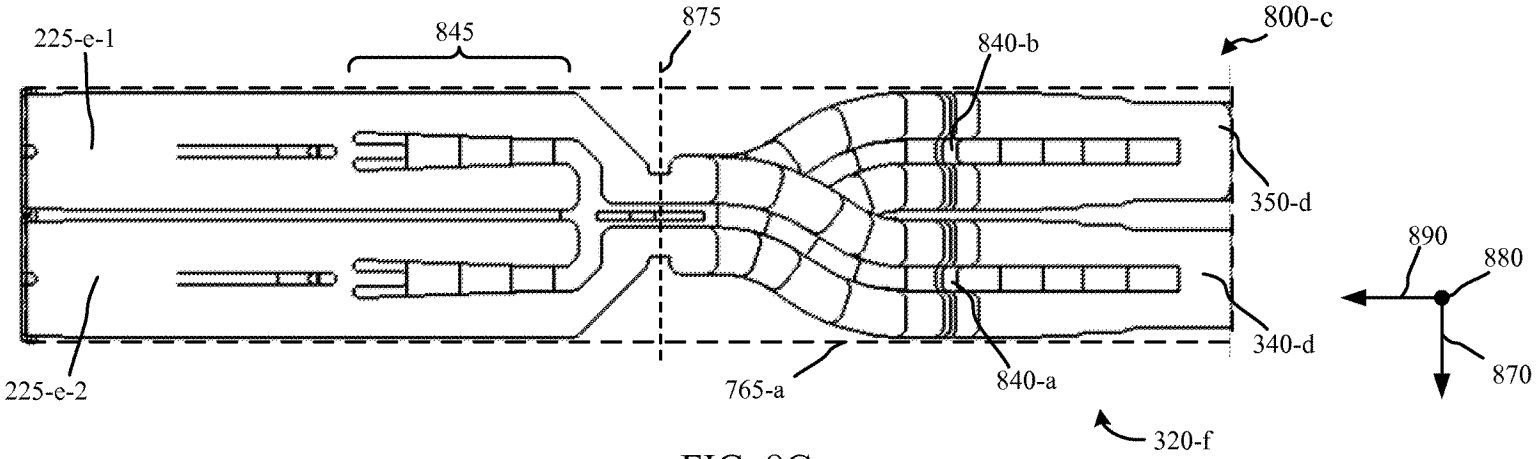

FIGS. 8B and 8C show a side view 800-*b* and a top view 800-*c*, respectively, of waveguides for unit cell 320-*f*. As seen in side view 800-*b*, unit cell 320-*f* includes a first waveguide network that includes multiple waveguide combiner/dividers and connects the divided waveguides 210-*e* of antenna elements 225-*e* associated with a first basis polarization to the first common waveguide 340-*d* and a second waveguide network that includes multiple waveguide combiner/dividers and connects the divided waveguides 215-*e* of antenna elements 225-*e* associated with a second basis polarization to the second common waveguide 350-*d*.

The first waveguide network may include a combiner/divider 840-*a* dividing the first common waveguide 340-*d* into intermediate waveguides 835-*a* and 835-*b*. The second waveguide network may include a combiner/divider 840-*b* dividing the second common waveguide 350-*d* into intermediate waveguides 835-*c* and 835-*d*. In unit cell 320-*f*, the combiner/dividers 840-*a* and 840-*b* are E-plane combiner/dividers (e.g., E-plane T-junctions).

As shown in FIGS. 8A-8C, the intermediate waveguides 835-*a*, 835-*b*, 835-*c*, and 835-*d* have an E-plane bend section and an H-plane bend section including a transition region of increasing height between the respective combiner/dividers 840 and the X-Y section plane 875. The height of the intermediate waveguides 835-*a* and 835-*b* at the X-Y section plane 875 may be approximately equal to a height of the first common waveguide 340-*d*. As can be seen in the side view 800-*b*, the intermediate waveguides 835-*a* and 835-*b* associated with the first basis polarization are interleaved in the Y-axis with the intermediate waveguides 835-*c* and 835-*d* corresponding to the second basis polarization at the X-Y section plane 875.

In the direction of increasing Z from X-Y section plane 875, waveguide combiner/divider 830-*a* is coupled between intermediate waveguide 835-*a* and the divided waveguides 210-*e* of antenna elements 225-*e*-1 and 225-*e*-2 associated with the first basis polarization and waveguide combiner/divider 830-*b* is coupled between intermediate waveguide 835-*b* and the divided waveguides 210-*e* of antenna elements 225-*e*-3 and 225-*e*-4 associated with the first basis polarization. Similarly, waveguide combiner/divider 830-*c* is coupled between intermediate waveguide 835-*c* and the divided waveguides 215-*e* of antenna elements 225-*e*-1 and 225-*e*-2 associated with the second basis polarization and waveguide combiner/divider 830-*d* is coupled between intermediate waveguide 835-*d* and the divided waveguides 215-*e* of antenna elements 225-*e*-3 and 225-*e*-4 associated with the second basis polarization. As illustrated in FIGS. 8A-8C, waveguide combiner/dividers 830 are H-plane tee combiner/dividers.

In some embodiments, unit cell 320-*f* may include one or more ridged waveguide sections. For example, FIGS. 8A-8C illustrate that intermediate waveguides 835 may have sections with ridges 865 including waveguide combiner/dividers 840, the H-plane bends and transition sections of increasing height, and waveguide combiner/dividers 830. Although illustrated as including single-ridged waveguide elements, the waveguide networks 805 may include non-ridged waveguide elements and/or dual-ridged waveguide elements, in some cases.

In some examples, antenna elements 225-*e* may include dielectric elements 855, which may increase an operational bandwidth of the antenna elements 225-*e*, improve impedance matching for signal propagation between the intermediate waveguides 835, the divided waveguides 210-*e*, 215-*e*, and the individual waveguide of the antenna elements 225-*e*, and improve impedance matching for signal propagation between the individual waveguide of the antenna elements 225-*e* and free space. In some cases, the dielectric elements 855 may effectively reduce a lower cutoff frequency of the individual waveguide of antenna elements 225-*e*. The dielectric elements 855 may also assist in matching the propagation constants between the ridged waveguides 835 and the antenna elements 225-*e* of a specific individual waveguide cross-sectional size.

In some embodiments, unit cell 320-*f* includes ridge transition region 845, which includes waveguide transition features for transitioning from the ridge-loading in intermediate waveguides 835 to the non-ridged antenna elements 225-*e*. The waveguide transition features may include decreasing steps of ridge depth and may include increases in width of the ridges as the depth is decreased. In some examples, dielectric elements 855 include transition features for transitioning from ridge-loading to dielectric loading in antenna elements 225-*e*. The waveguide transition features may be matched or complementary with the transition features of the dielectric elements 855.

Figure 8D:
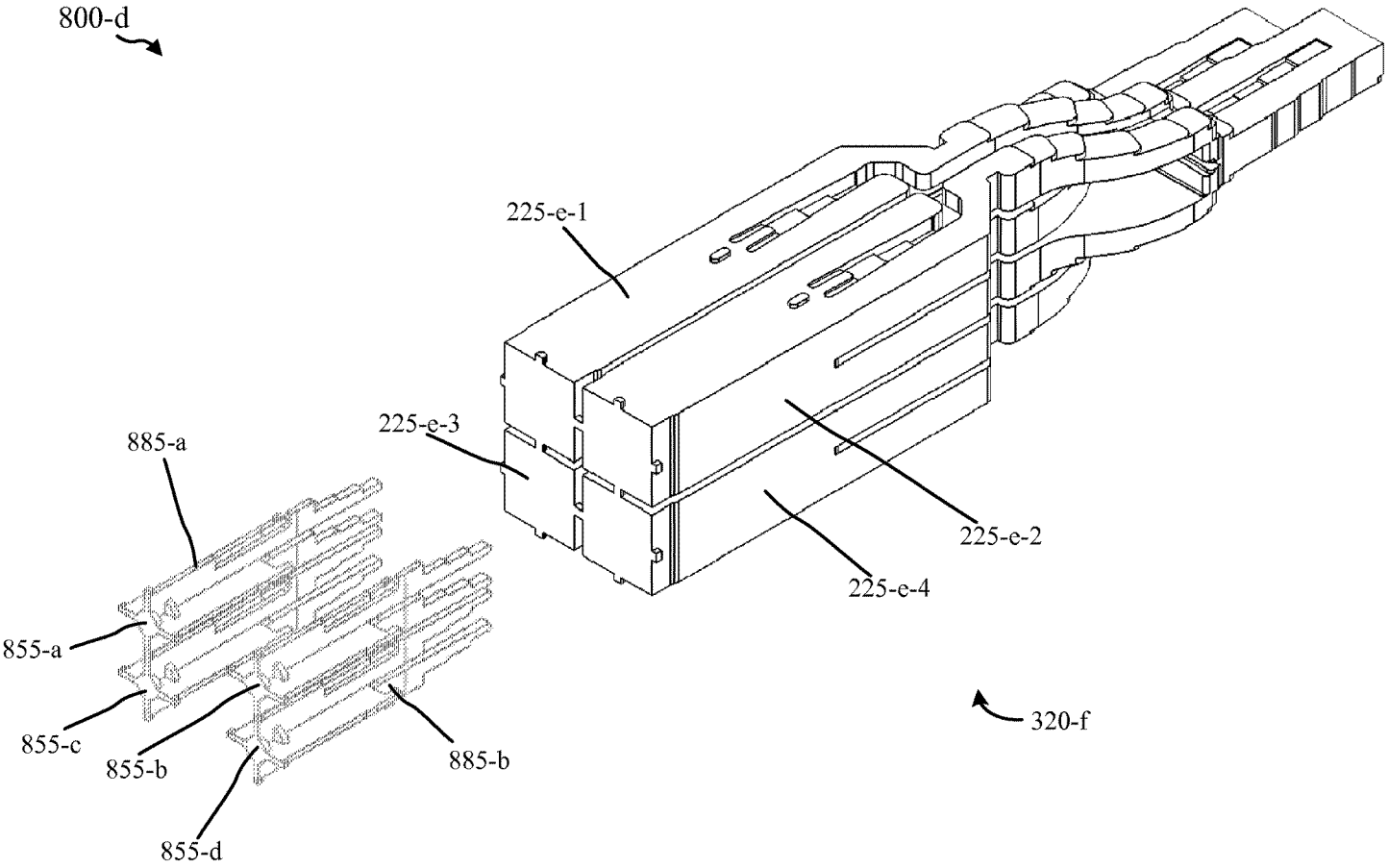

FIG. 8D shows an exploded view 800-*d* of waveguides for unit cell 320-*f*, showing dielectric assemblies 885-*a* and 885-*b*. Dielectric assembly 885-*a* includes dielectric elements 855-*a* and 855-*c* corresponding to antenna elements 225-*e*-1 and 225-*e*-3, respectively. Dielectric assembly 885-*b* includes dielectric elements 855-*b* and 855-*d* corresponding to antenna elements 225-*e*-2 and 225-*e*-4, respectively. Dielectric assemblies 885-*a* and 885-*b* may be configured to be inserted into unit cell 320-*f* and may include features for matching signal propagation and insertion features for support and retention in the antenna elements 225-*e*. Dielectric assemblies 885 may be constructed out of a material selected for its electrical properties and manufacturability. In some examples, dielectric assemblies 885 may have a dielectric constant of approximately 2.1. For example, dielectric assemblies 885 may be made out of Polytetrafluoroethylene (PTFE) (also sold under the brand name Teflon by DuPont Co.), or a thermoplastic polymer such as Polymethylpentene (e.g., TPX, a 4-methylpentene-1 based polyolefin manufactured by Mitsui Chemicals).

In some examples, ridge loading may lower a cutoff frequency for the same waveguide width. Thus, the ridge loading and dielectric elements 855 illustrated in FIGS. 8A-8D may allow unit cell 320-*f* to have a smaller cross sectional size for the same or a similar operational bandwidth as would be provided by waveguide elements not including these features.

In some examples of dual-polarized antennas 140 employing the unit cells 320-*e* of FIGS. 7A-7C or the unit cells 320-*f* of 8A-8C, alternating rows or pairs of rows of septum polarizers along one dimension (e.g., along Y-axis 780 or 880) may be inverted with respect to each other. For example, FIG. 7E shows septum polarizers for antenna elements 225-*d*-1 and 225-*d*-2 of unit cell 320-*e* with the septums starting on the left side of the individual waveguide and increasing in width from left to right towards the divided waveguides 210-*d*, 215-*d*. An alternating row of antenna elements (e.g., antenna elements 225-*d*-3 and 225-*d*-4) may have septums staring on the right side of the individual waveguide and increasing in width from right to left towards the divided waveguides 210-*d*, 215-*d*). As can be understood, a similar configuration may be employed using the unit cells 320-*f* of FIGS. 8A-8C. Alternatively, the antenna elements 225 of alternating rows of unit cells 320-*e* or 320-*f* in one dimension (e.g., along Y-axis 780 or 880) may be mirrored (e.g., with respect to X-axis 770 or 870), inverting every other pair of septum polarizers. In some cases, inverting alternating rows or pairs of rows of septum polarizers may mitigate mismatch conditions occurring in higher order modes for waves communicated via the dual-polarized antenna 140.

Figure 9A:
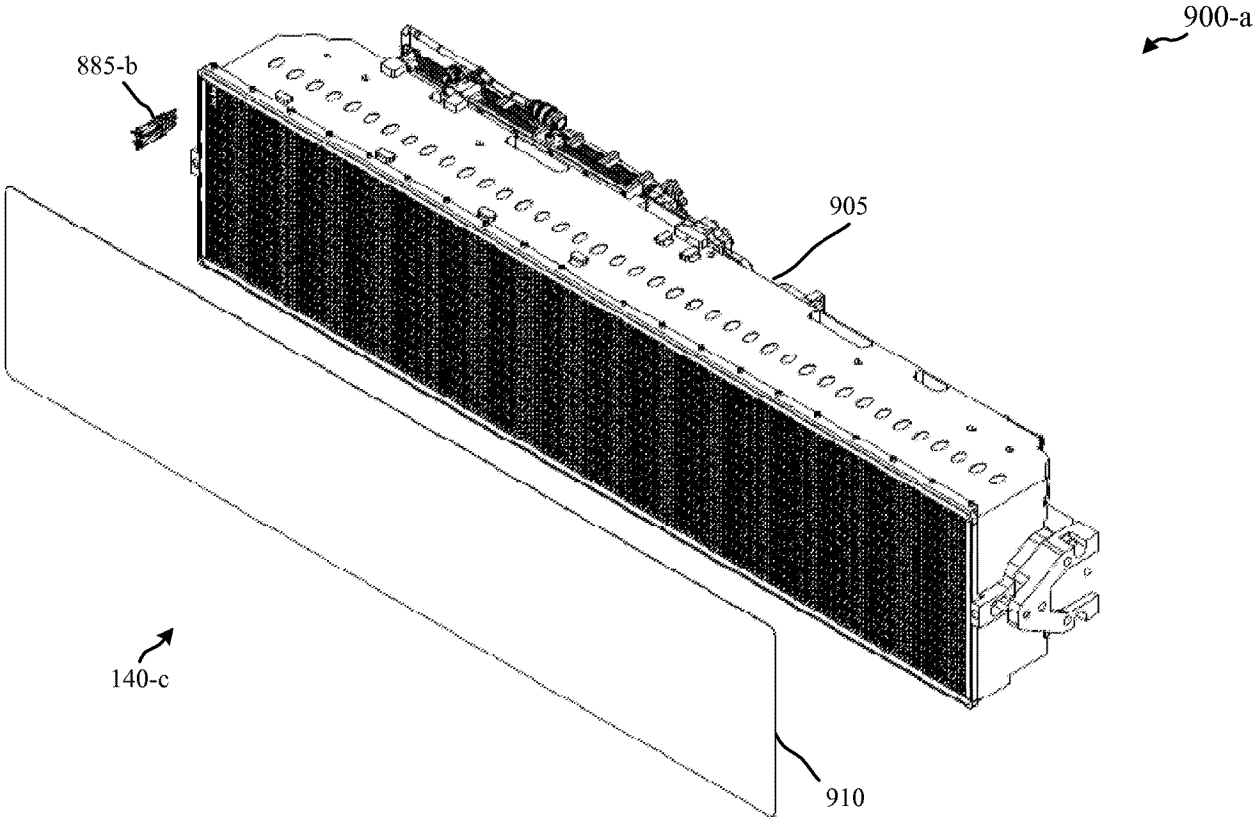
FIGS. 9A and 9B show exploded views of a waveguide device for a dual-polarized antenna in accordance with various aspects of the present disclosure.
Figure 9B:
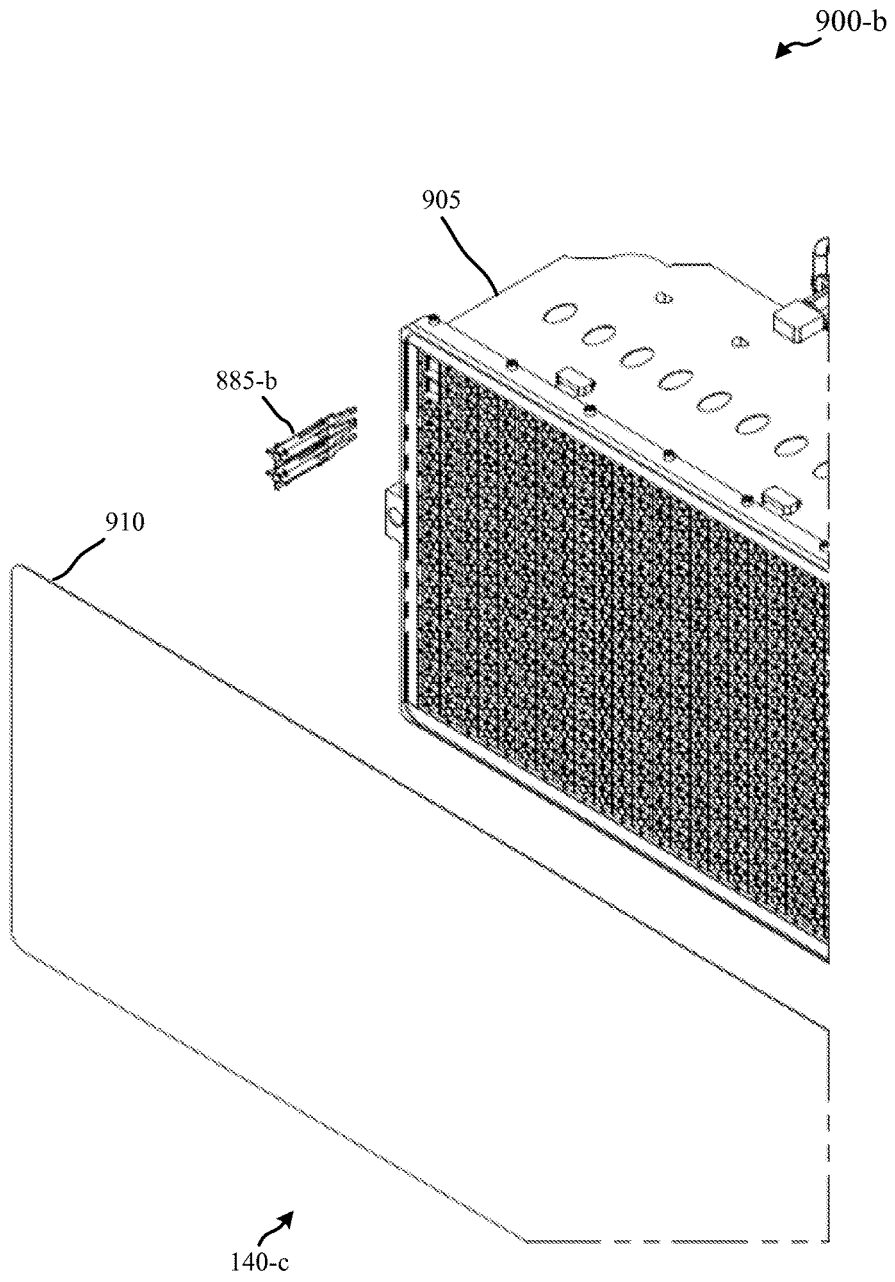

FIGS. 9A and 9B show exploded views 900-*a* and 900-*b*, respectively, of a waveguide device 905 for a dual-polarized antenna 140-*c* in accordance with various aspects of the disclosure. The waveguide device 905 may illustrate, for example, portions of the waveguide device 305 of FIG. 3. The waveguide device 905 may employ the unit cells 320 described with reference to FIGS. 3, 4, 5, 6, 7A-7C, and 8A-8C.

As shown in exploded views 900-*a* and 900-*b*, dual-polarized antenna 140-*c* may have a close-out layer 910, which may be a suitable material for keeping dust and other particles out of the waveguide devices of dual-polarized antenna 140-*c* while not adversely impacting the electrical properties of waves transmitted and received by dual-polarized antenna 140-*c*. In some examples, close-out layer 910 is approximately 10 thousandths of an inch thick and is made from a material having a dielectric constant that is similar to dielectric assemblies 885. In one example, close-out layer 910 is made from a woven glass PTFE resin.

As can be seen in exploded view 900-*b*, dielectric assembly 885-*b* includes dielectric elements for two antenna elements of dual-polarized antenna 140-*c* and is inserted into the antenna elements prior to covering with close-out layer 910.

Figure 10A:
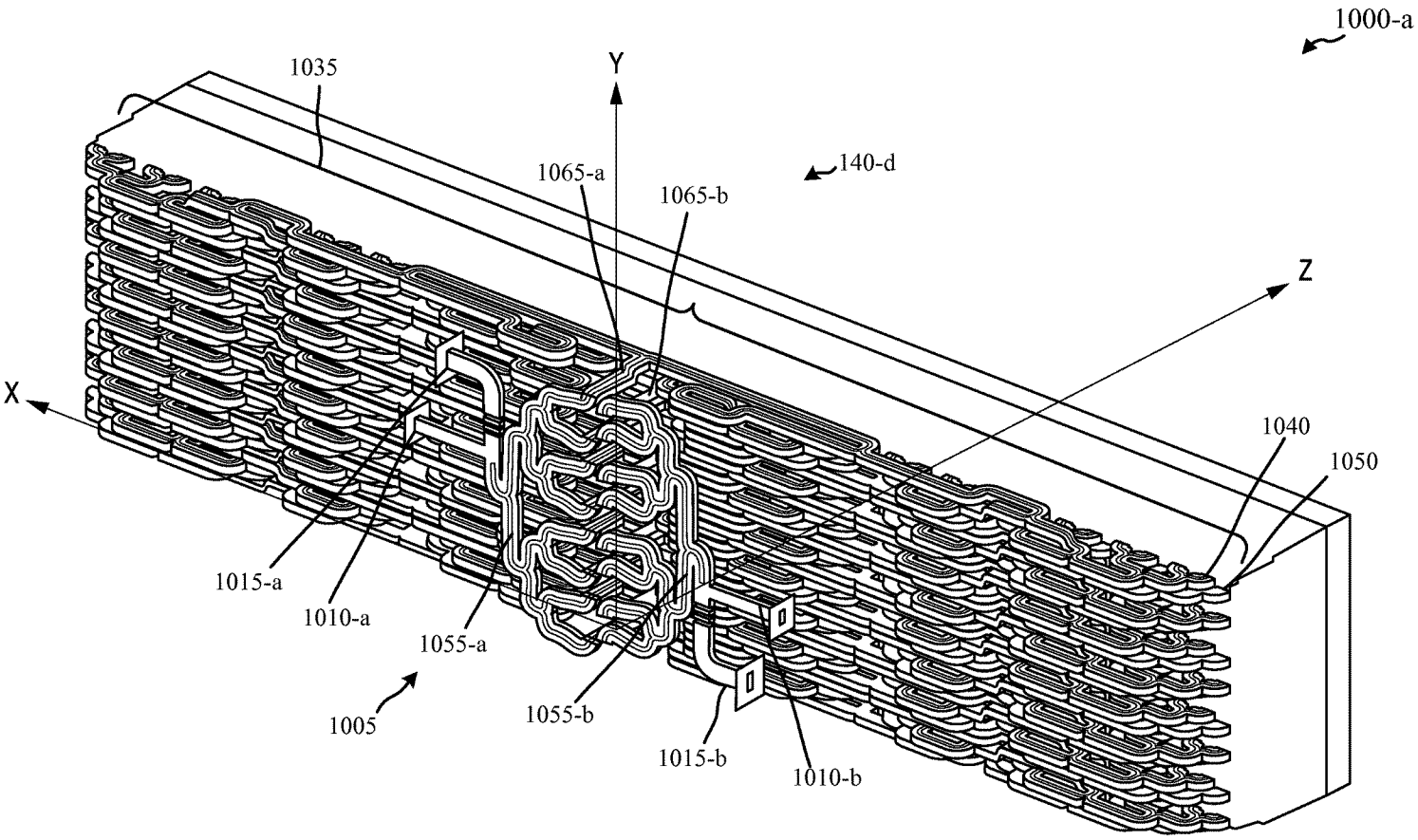
FIGS. 10A and 10B show views illustrating a waveguide network for a dual-polarized antenna in accordance with various aspects of the present disclosure.

FIG. 10A shows a view 1000-*a* illustrating a waveguide device 1005 for a dual-polarized antenna 140-*d* in accordance with various aspects of the present disclosure. The waveguide device 1005 may illustrate, for example, portions of the waveguide device 305 of FIG. 3. The waveguide device 1005 may employ the unit cells 320 described with reference to FIGS. 3, 4, 5, 6, 7A-7C, and 8A-8C.

The waveguide device 1005 includes waveguide networks connecting transmission port 1010-*a* and reception port 1015-*a* associated with a first basis polarization POL1 with a set of first common waveguides 1040 for each of the unit cells (only one first common waveguide 1040 labeled for clarity) of the dual-polarized antenna 140-*d*. The waveguide device 1005 also includes waveguide networks connecting transmission port 1010-*b* and reception port 1015-*b* associated with a second basis polarization POL2 with a set of second common waveguides 1050 (only one second common waveguide 1050 labeled for clarity) for each of the unit cells of the antenna 140-*b*.

The waveguide device 1005 includes a first elevation power combiner/divider network 1055-*a* associated with POL1 and a second elevation power combiner/divider network 1055-*b* associated with POL2. The first elevation power combiner/divider network 1055-*a* may have M elevation ports 1065-*a* (only one elevation port 1065-*a* labeled for clarity) associated with POL1 and the second elevation power combiner/divider network 1055-*b* may have M elevation ports 1065-*b* (only one elevation port 1065-*a* labeled for clarity) associated with POL2. The elevation power combiner/divider networks 1055 may be of the corporate type and may include equal (e.g., substantially equal to manufacturing tolerances) waveguide path lengths (e.g., equal phases) between the elevation stage common port and each of the M elevation ports. In the illustrated example, M=8. However, other designs including more or fewer elevation ports may be constructed using similar waveguide configurations.

The waveguide device 1005 includes M azimuth combiner/dividers 1035 associated with each of the first and second basis polarizations POL1 and POL2. Each azimuth combiner/divider 1035 may connect an elevation port 1065 to N common waveguides 1040, 1050 associated with one of the first and second basis polarizations POL1 and POL2. The azimuth combiner/divider 1035 may be of the corporate type and may include substantially equal waveguide path lengths (e.g., equal phases) between the corresponding elevation port 1065 and each of the N azimuth ports for each basis polarization.

Figure 10B:
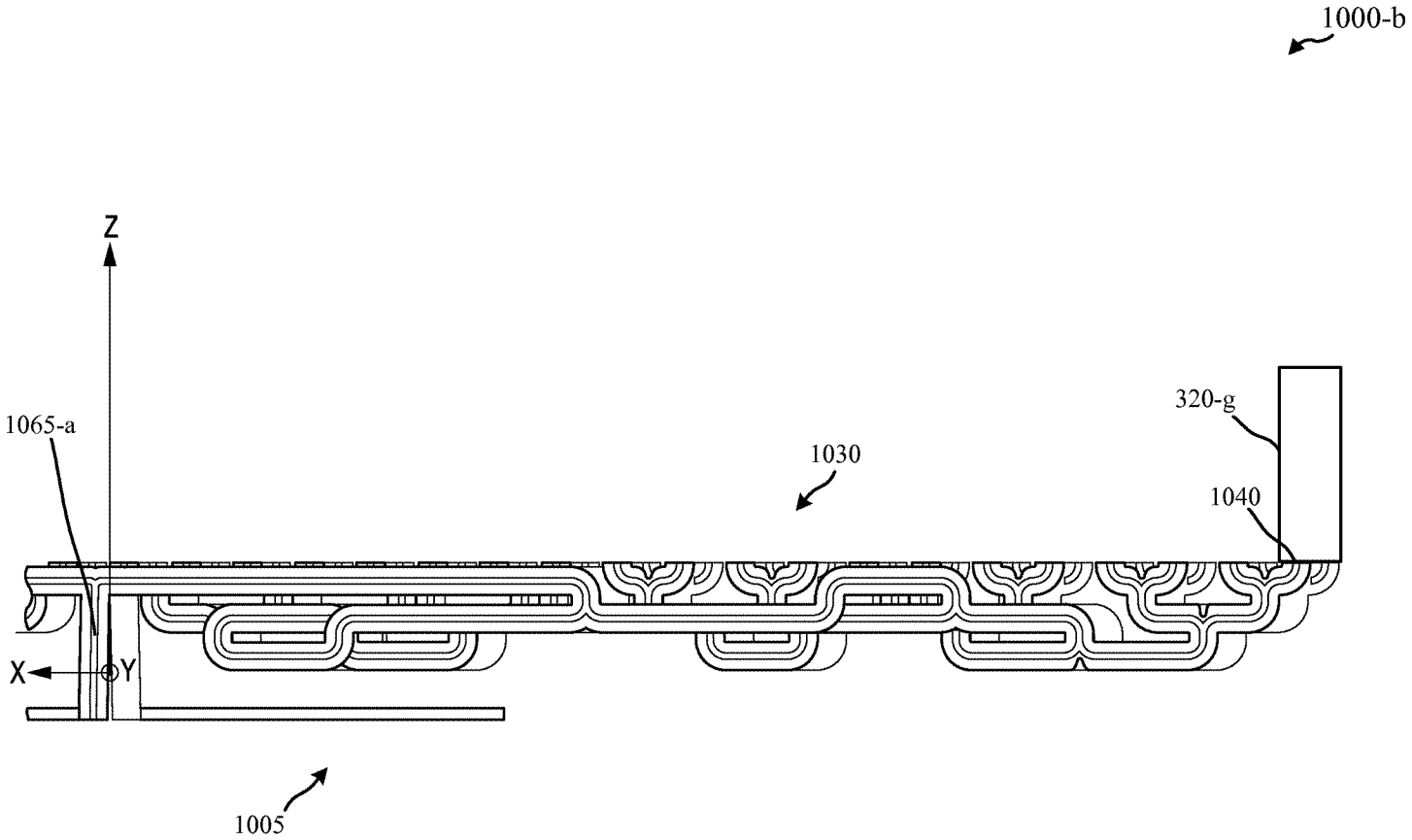

FIG. 10B illustrates a portion of an azimuth combiner/divider 1035 for waveguide device 1005 in more detail. FIG. 10B illustrates one half of a 40:1 azimuth combiner/divider 1035 (e.g., N=40). However, other designs including larger or smaller azimuth combiner/divider networks are possible using similar waveguide configurations for constructing dual-polarized antennas of different sizes.

The waveguide device 1005 may also include M·N unit cells 320-*g*. Thus, the waveguide device 1005 may include an M·N combiner/divider feeding N unit cells 320-*g*, to result in an antenna with M·N·A antenna elements. In the illustrated example, M=8, N=40, and A=4. Thus, FIGS. 10A and 10B illustrate an example dual-polarized antenna 140-*d* having 1,280 antenna elements. In some cases, however, the dual-polarized antenna 140-*d* may include less than N unit cells 320 for some rows of azimuth combiner/dividers 1035. For example, to reduce the swept profile of the antenna dual-polarized 140-*d*, some of the rows of unit cells 320 (e.g., towards the top and/or bottom) may include fewer unit cells 320, resulting in a taper or rounding of the corners of the dual-polarized antenna 140-*d* that reduces the size of a radome used for the dual-polarized antenna 140-*d*.

Figure 11:
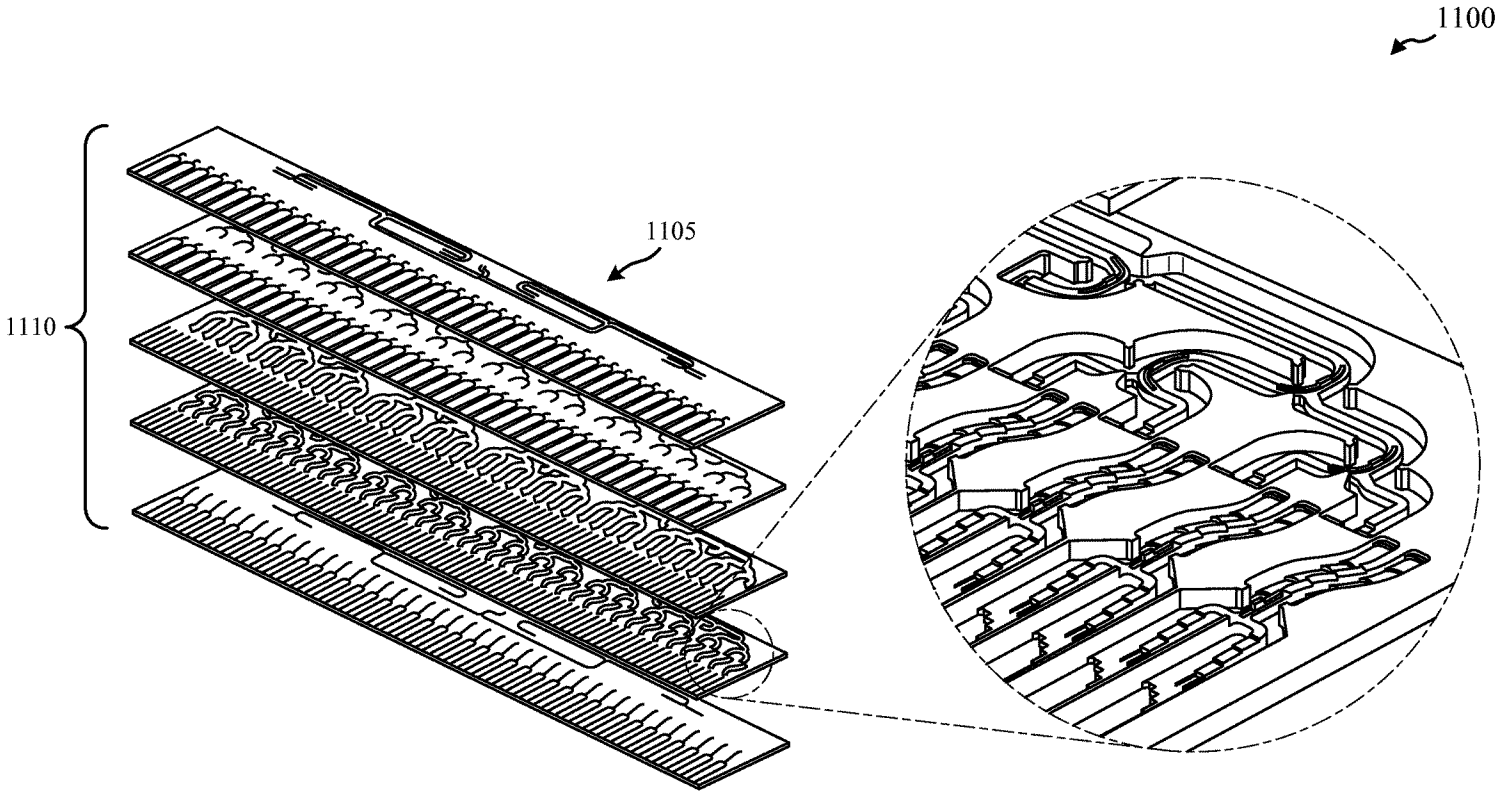
FIG. 11 shows a view of a portion of a waveguide device for a dual-polarized antenna in accordance with various aspects of the present disclosure.

FIG. 11 shows a view 1100 of a portion of a waveguide device 1105 for a dual-polarized antenna in accordance with various aspects of the present disclosure. The waveguide device 1105 may be a layered assembly including multiple layers 1110 oriented orthogonally to a cross-section of the antenna elements 225 of the dual-polarized antenna. As can be seen in the detail view, each layer 1110 may include recesses in a top surface, a bottom surface, or both surfaces of the layer that define portions of unit cells 320 and waveguide networks such as elevation power combiner/divider networks 355 and azimuth combiner/dividers 335 illustrated in FIG. 3.

In some examples, the layers 1110 are machined aluminum waveguide sub-assemblies. The machined waveguide sub-assemblies 1110 may be vacuum brazed together to form the waveguide device 1105. FIG. 11 illustrates machined waveguide sub-assemblies 1110 for a ridged waveguide device such as that incorporating unit cells 320-*f* of FIGS. 8A-8D. However, similar techniques may be used to form waveguide sub-assemblies 1110 for other waveguide devices such as a waveguide device incorporating unit cells 320-*e* of FIGS. 7A-7C.

The detailed description set forth above in connection with the appended drawings describes exemplary embodiments and does not represent the only embodiments that may be implemented or that are within the scope of the claims. The term "example" used throughout this description means "serving as an example, instance, or illustration," and not "preferred" or "advantageous over other embodiments." The detailed description includes specific details for the purpose of providing an understanding of the described techniques. These techniques, however, may be practiced without these specific details. In some instances, well-known structures and devices are shown in block diagram form in order to avoid obscuring the concepts of the described embodiments.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The functions described herein may be implemented in various ways, with different materials, features, shapes, sizes, or the like. Other examples and implementations are within the scope of the disclosure and appended claims. Features implementing functions may also be physically located at various positions, including being distributed such that portions of functions are implemented at different physical locations. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

As used in the present disclosure, the term "parallel" is not intended to suggest a limitation to precise geometric parallelism. For instance, the term "parallel" as used in the present disclosure is intended to include typical deviations from geometric parallelism relating to such considerations as, for example, manufacturing and assembly tolerances. Furthermore, certain manufacturing process such as molding or casting may require positive or negative drafting, edge chamfers and/or fillets, or other features to facilitate any of the manufacturing, assembly, or operation of various components, in which case certain surfaces may not be geometrically parallel, but may be parallel in the context of the present disclosure.

Similarly, as used in the present disclosure, the terms "orthogonal" and "perpendicular", when used to describe geometric relationships, are not intended to suggest a limitation to precise geometric perpendicularity. For instance, the terms "orthogonal" and "perpendicular" as used in the present disclosure are intended to include typical deviations from geometric perpendicularity relating to such considerations as, for example, manufacturing and assembly tolerances. Furthermore, certain manufacturing process such as molding or casting may require positive or negative drafting, edge chamfers and/or fillets, or other features to facilitate any of the manufacturing, assembly, or operation of various components, in which case certain surfaces may not be geometrically perpendicular, but may be perpendicular in the context of the present disclosure.

As used in the present disclosure, the term "orthogonal," when used to describe electromagnetic polarizations, is meant to distinguish two polarizations that are separable. For instance, two linear polarizations that have unit vector directions that are separated by 90 degrees can be considered orthogonal. For circular polarizations, two polarizations are considered orthogonal when they share a direction of propagation, but are rotating in opposite directions.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the widest scope consistent with the principles and novel features disclosed herein.

What is claimed is:

1. A dual-polarized antenna comprising:

a plurality of unit cells, each unit cell comprising:

a first common waveguide associated with a first polarization;

a second common waveguide associated with a second polarization;

a two-by-two array of antenna elements, each antenna element comprising a polarizer coupled between an individual waveguide and first and second divided waveguides associated with the first and second polarizations, respectively, wherein a cross-section of the individual waveguides of the two-by-two array defines a unit cell boundary for each unit cell;

a first waveguide network comprising at least one waveguide combiner/divider and connecting each of the first divided waveguides of the plurality of antenna elements with the first common waveguide via a continuous waveguide signal path; and a second waveguide network comprising at least one waveguide combiner/divider and connecting each of the second divided waveguides of the plurality of antenna elements with the second common waveguide via a continuous waveguide signal path, wherein the first waveguide network and the second waveguide network are each entirely within a projection of the unit cell boundary along a direction that is normal to the cross-section that defines the unit cell boundary.

2. The dual-polarized antenna of claim 1, wherein the dual-polarized antenna comprises a layered assembly comprising the plurality of unit cells, the layered assembly comprising a plurality of layers oriented orthogonal to the cross-section that defines the unit cell boundary.

3. The dual-polarized antenna of claim 1, wherein each individual waveguide shares waveguide walls with two other individual waveguides of the two-by-two array.

4. The dual-polarized antenna of claim 1, wherein adjacent individual waveguides of adjacent unit cells of the plurality of unit cells share waveguide walls with each other.

5. The dual-polarized antenna of claim 1, wherein:

the first waveguide network comprises:

a first waveguide combiner/divider coupled between the first common waveguide and a first pair of intermediate waveguides; and a set of second waveguide combiner/dividers coupled between the first pair of intermediate waveguides and the first divided waveguides of the plurality of antenna elements; and the second waveguide network comprises:

a third waveguide combiner/divider coupled between the second common waveguide and a second pair of intermediate waveguides; and a set of fourth waveguide combiner/dividers coupled between the second pair of intermediate waveguides and the second divided waveguides of the plurality of antenna elements.

6. The dual-polarized antenna of claim 5, wherein the first common waveguide and the second common waveguide are offset in two-dimensions.

7. The dual-polarized antenna of claim 5, wherein the first and third waveguide combiner/dividers comprise E-plane combiner/dividers and the sets of second and fourth waveguide combiner/dividers comprise H-plane combiner/dividers.

8. The dual-polarized antenna of claim 7, wherein each intermediate waveguide of the first and second pairs of intermediate waveguides comprises an H-plane bend section including a transition region of increasing height such that a height of the each intermediate waveguide at a corresponding H-plane combiner/divider is equal to a height of the first and second common waveguides.

9. The dual-polarized antenna of claim 5, wherein the first common waveguide and the second common waveguide are aligned in a first dimension, and offset in a second dimension.

10. The dual-polarized antenna of claim 5, wherein the first and third waveguide combiner/dividers comprise first E-plane combiner/dividers and the sets of second and fourth waveguide combiner/dividers comprise second E-plane combiner/dividers.

11. The dual-polarized antenna of claim 10, wherein each intermediate waveguide of the first and second pairs of intermediate waveguides comprises:

a first 90-degree H-plane bend section coupled with a corresponding first E-plane combiner/divider;

a 180-degree E-plane bend section coupled with the first 90-degree H-plane bend section; and a second 90-degree H-plane bend section coupled between the 180-degree E-plane bend section and a corresponding second E-plane combiner/divider, the second 90-degree H-plane bend section including a transition region of increasing height, wherein a height of the each intermediate waveguide at the corresponding second E-plane combiner/divider is equal to a height of the first and second common waveguides.

12. The dual-polarized antenna of claim 1, wherein the first and second waveguide networks are ridged waveguides.

13. The dual-polarized antenna of claim 1, wherein the polarizers comprise septum polarizers.

14. The dual-polarized antenna of claim 13, wherein the septum polarizers convert between first and second circular polarizations in the individual waveguides and first and second linear polarizations in the first and second divided waveguides, respectively.

15. The dual-polarized antenna of claim 13, wherein every other septum polarizer along a dimension of the dual-polarized antenna is inverted.

16. The dual-polarized antenna of claim 13, wherein the septum polarizers of every other unit cell of the plurality of unit cells along a dimension of the dual-polarized antenna are inverted.

* * * * *